US009216123B2

(12) United States Patent
Tekulve

(10) Patent No.: US 9,216,123 B2
(45) Date of Patent: Dec. 22, 2015

(54) BED WITH PIVOTABLE BED SURFACE

(71) Applicant: Daniel R. Tekulve, Batesville, IN (US)

(72) Inventor: Daniel R. Tekulve, Batesville, IN (US)

( * ) Notice: Subject to any disclaimer, the term of this patent is extended or adjusted under 35 U.S.C. 154(b) by 0 days.

(21) Appl. No.: 14/450,715

(22) Filed: Aug. 4, 2014

(65) Prior Publication Data

US 2015/0089741 A1 Apr. 2, 2015

Related U.S. Application Data

(63) Continuation of application No. 13/224,320, filed on Sep. 1, 2011, now Pat. No. 8,793,825.

(60) Provisional application No. 61/379,387, filed on Sep. 1, 2010, provisional application No. 61/382,920, filed on Sep. 14, 2010.

(51) Int. Cl.

| | |
|---|---|
| ***A61G 7/015*** | (2006.01) |
| ***A61G 7/10*** | (2006.01) |
| ***A61G 7/053*** | (2006.01) |
| ***A61G 7/16*** | (2006.01) |
| *A61G 7/05* | (2006.01) |

(52) U.S. Cl.

CPC ..... *A61G 7/1076* (2013.01); *A61G 7/015* (2013.01); *A61G 7/053* (2013.01); *A61G 7/0506* (2013.01); *A61G 7/0507* (2013.01); *A61G 7/16* (2013.01); *A61G 2007/0509* (2013.01)

(58) Field of Classification Search

CPC ..... A61G 7/15; A61G 7/716
USPC ..... 5/613, 424, 616–618
See application file for complete search history.

(56) References Cited

U.S. PATENT DOCUMENTS

| | | | | |
|---|---|---|---|---|
| 3,886,610 | A | 6/1975 | Shelden | |
| 4,095,296 | A | 6/1978 | Ferro | |
| 4,336,621 | A | 6/1982 | Schwartz et al. | |
| 5,444,883 | A | 8/1995 | Iura | |
| 5,497,518 | A * | 3/1996 | Iura | 5/618 |
| 6,237,173 | B1 | 5/2001 | Schlichter et al. | |
| 6,516,480 | B2 | 2/2003 | Elliott | |
| 6,739,005 | B2 | 5/2004 | Davis | |
| 6,742,205 | B2 | 6/2004 | Dewert | |
| 7,441,290 | B1 | 10/2008 | Flick | |
| 7,555,796 | B2 | 7/2009 | Lewis et al. | |
| 2002/0078509 | A1 | 6/2002 | Williams | |
| 2005/0039265 | A1 | 2/2005 | Gladney | |
| 2005/0120485 | A1 * | 6/2005 | Sebastien | 5/662 |
| 2010/0005591 | A1 | 1/2010 | Manouchehri | |
| 2013/0007960 | A1 | 1/2013 | Manouchehri et al. | |

* cited by examiner

*Primary Examiner* — Fredrick Conley
(74) *Attorney, Agent, or Firm* — R. Randall Frisk

(57) ABSTRACT

A central bed having a single longitudinal bed frame and a bed section mounted to the frame for rotation about a substantially vertical axis between a home position aligned with the bed frame and an away position and with a lower leg bed section that is movable away from the central bed section to enable rotation of the central bed section.

17 Claims, 23 Drawing Sheets

BED WITH PIVOTABLE BED SURFACE

CROSS-REFERENCE TO RELATED APPLICATIONS

This application claims the benefit of U.S. patent application Ser. No. 13/224,320, filed Sep. 1, 2011, now U.S. Pat. No. 8,793,825, issued Aug. 5, 2014, which claims the benefit of provisional U.S. Patent Application Ser. No. 61/379,387 filed Sep. 1, 2010 and provisional U.S. Patent Application Ser. No. 61/382,920 filed Sep. 14, 2010, which applications and patent are hereby incorporated by reference in their entirety.

FIELD OF THE INVENTION

The present invention relates to the field of health care devices, and more specifically, to a health care bed having a pivotable bed surface.

DESCRIPTION OF THE PREFERRED EMBODIMENT

Figure 1:
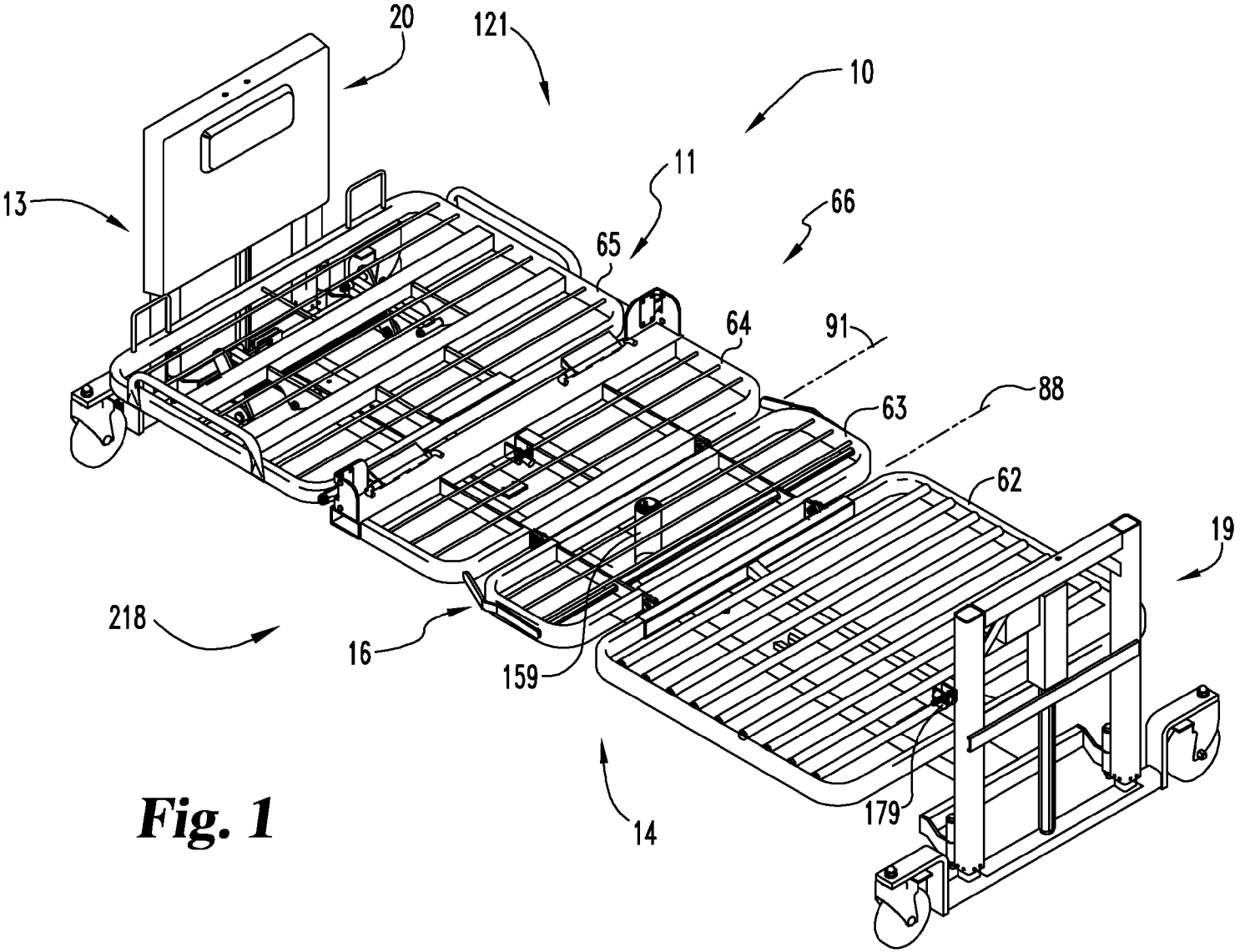
FIG. 1 is a perspective view of a healthcare bed 10 with pivoting bed surface 11 in accordance with one embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, and any alterations and modifications in the illustrated device, and further applications of the principles of the invention as illustrated therein are herein contemplated as would normally occur to one skilled in the art to which the invention relates.

Figures 2, 25:
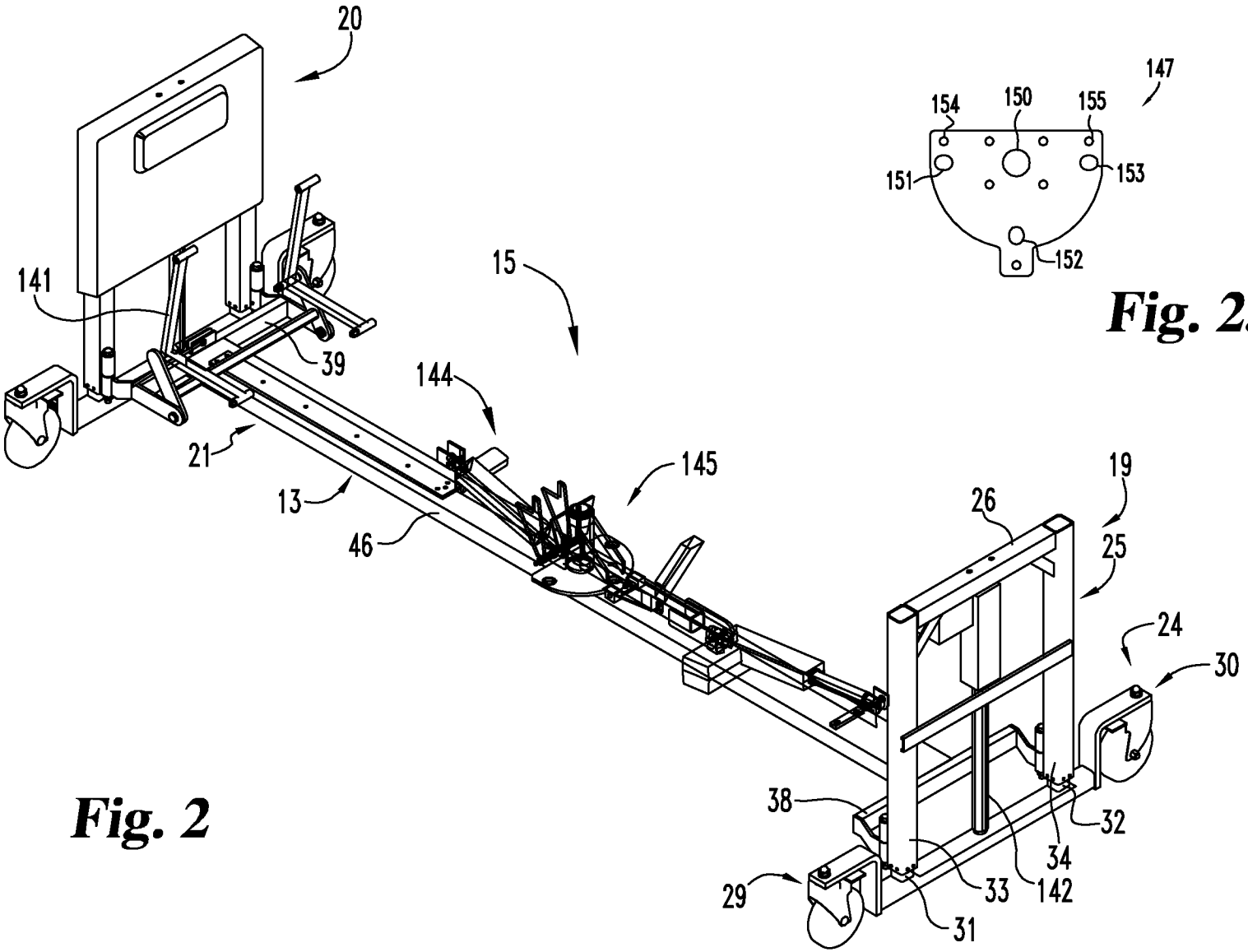
FIG. 2 is perspective view of the healthcare bed 10 of FIG. 1, with the back, seat, upper leg and lower leg sections 62-65 removed and with upper link arms 229 and 230 shown in two articulated positions.
FIG. 25 is a plan view of the swivel plate 147 of the rotation locking mechanism of the healthcare bed 10 of FIG. 1.

Referring to the figures, there is shown a healthcare bed 10 with pivoting bed surface 11. FIGS. 1 and 2 show the basic elements of bed 10, which generally include a main frame 13, an articulating bed surface 14, apparatus 15 for moving one or more components of bed 10, and apparatus 16 for releasably locking one or more components of bed 10 in a desired position relative to one or more other components of bed 10.

Main frame 13 generally comprises a head stanchion 19, a foot stanchion 20 and a longframe member 21 extending therebetween. Head and foot stanchions 19 and 20 are basically identical with any differences being noted herein. Head stanchion 19 includes a base member 24, a mast 25 extending up from base member 24, and a top member 26. Base member 24 includes a pair of casters 29 and 30. Mast 25 here comprises parallel rails 31 and 32 extending up from base member 24 and mating sleeves 33 and 34 extending down from top member 26, each sleeve 33/34 receiving therein a corresponding one of rails 31 and 32 for vertical, telescopic reciprocation therewith.

Longframe member 21 generally includes a support rail 46 and connection means for connecting support rail 46 to head and foot stanchions 19 and 20. Support rail 46 is here a single bar having a composition and configuration sufficient to readily support the forces applied thereto, but small enough to have a small lateral profile, as described herein. Any composition and configuration that achieves both high strength (to bear the weight of one or more persons on the bed and, in one embodiment, to exhibit minimal or no noticeable flexing under a 600 lb. load) and small profile (to minimize obstruction to the user and/or one or more caregivers while attending to or assisting the user to get on and off the bed) is contemplated by the present invention. In the present invention, support rail 46 has a rectangular cross-section over at least that portion of its length where minimal obstruction by the lower and central positions of the bed frame is desired, that is, laterally outside (at 48 and 49 in FIG. 5) of the bed surface when the pivoting bed frame 11 is in the egress position 50. These areas, between the articulating bed surface 14 when it is in the egress position 50 and the head and foot stanchions 19 and 20, are referred to as the access regions 48 and 49. In one embodiment, support rail is made of ⅛ in. mild steel 2 in.×4 in. box frame. Support rail 46 is shown as a single rail, but alternative embodiments are contemplated wherein support rail 46 comprises two or more members extending, as least through the access regions 48 and 49, but still defining a laterally narrow footprint. In one embodiment, that 2 in.×4 in. box frame rail 46 has a four inch lateral footprint. Other compositions for support rail 46 may permit an even narrower footprint or a slightly wider footprint, so long as the support rail lateral footprint, through at least one of the access regions 48 and 49, is much narrower than the bed surfaces, and preferably less than 12 inches. It is desired that the lateral footprint be as narrow as possible.

The means for connecting support rail 46 to head and foot stanchions 19 and 20 here comprises head and foot connection bars 38 and 39 for rigid connection to corresponding sleeves 33 and 34 at the head and foot of bed 10, as shown in the figures.

Articulating bed surface 14 generally includes a back section 62, a seat section 63, an upper leg section 64, and a lower leg section 65. Sections 62-65 are pivotally interconnected along parallel, horizontal axes. As used herein, "forward" and forwardly" refer toward the head of the bed, and "rear" and "rearwardly" refer toward the foot of the bed.

Figure 3:
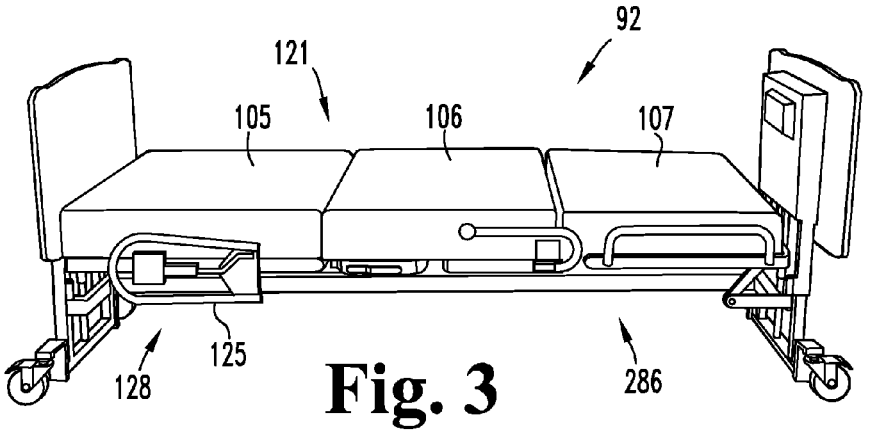
FIGS. 3-7 are perspective views of the healthcare bed 10 of FIG. 1 shown with mattress panels in various stages of articulation and use.
Figure 14A:
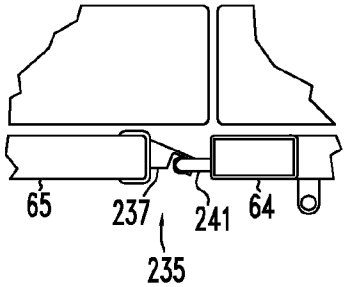
FIG. 14*a* is an enlarged view of a portion of the healthcare bed 10 of FIG. 14 showing the hook and loop configuration 237 and 241.
Figure 14:
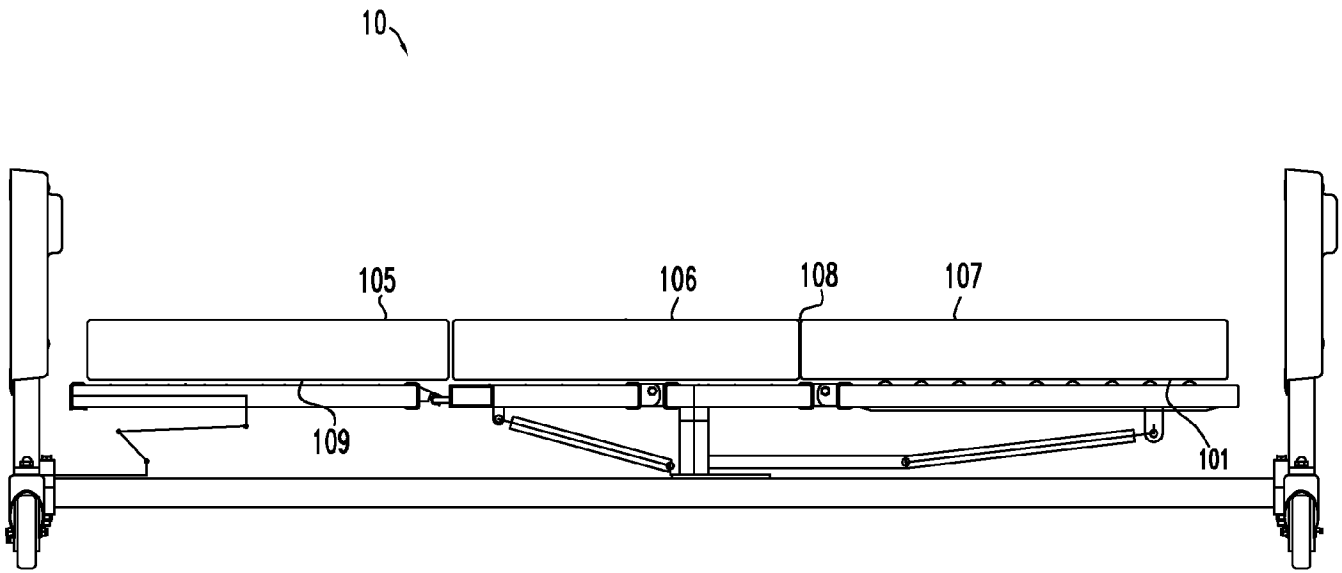
FIGS. 14-19 are plan, elevational views of the healthcare bed 10 of FIG. 1 with mattress panels 92 and in various stages of articulation.
Figure 19:
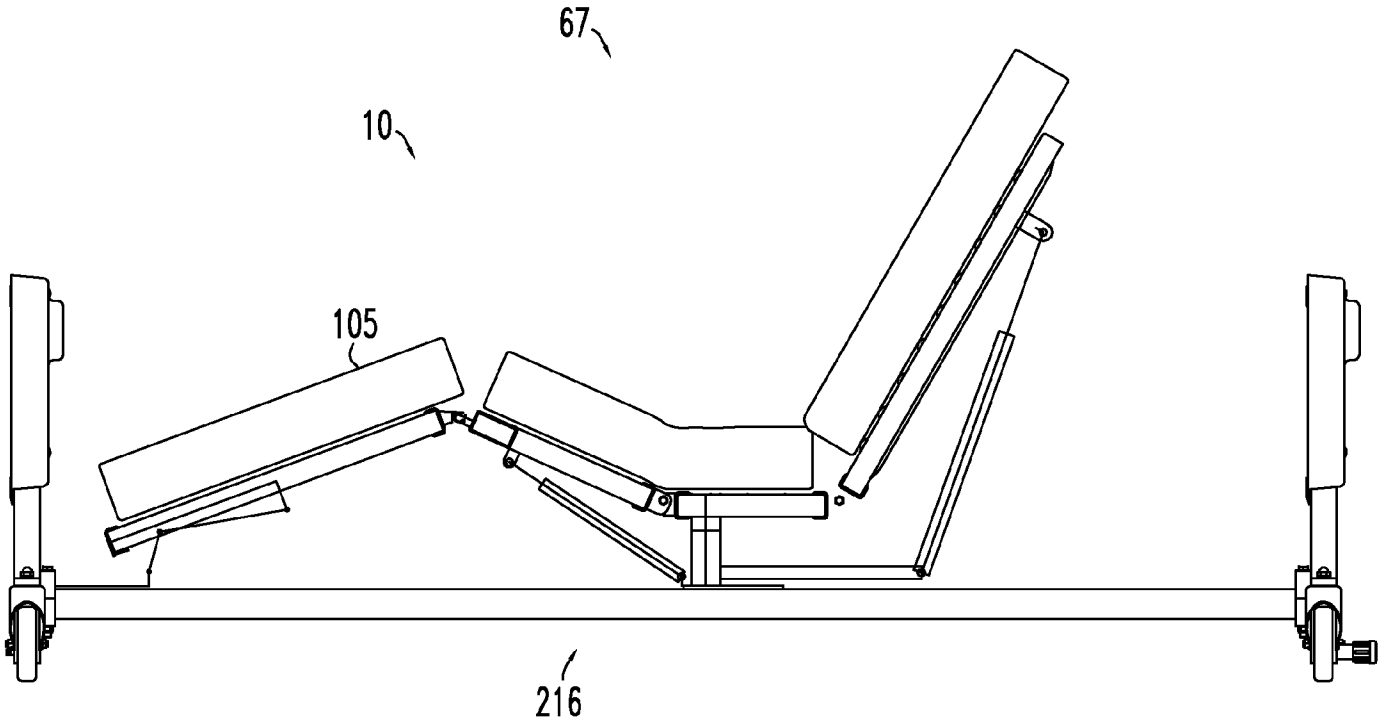

The fully reclined position 66, as used herein, refers to the condition where all the bed section members (back 62, seat 63, upper leg 64 and lower leg 65) are juxtaposed in a generally horizontal and co-planar position, as shown in FIGS. 1, 3 and 14. If a bed section is referred to as being in the fully reclined position, it means that that bed section is in the generally horizontal position and co-planar with seat section 63 (since the seat section 63 is always in a fixed, horizontal, but perhaps rotated, position) even though one or more of the other sections may not be. A fully inclined position 67, as used herein, refers to the condition where the same bed sections, through their pivotal interconnections, are tilted relative to each other as far from the fully reclined position as their linkages will allow, thereby inclining the back section 62 and inclining the upper leg section 64 and lower leg section 65 to form a slightly inverted "V" shape (when lower leg section 65 is connected with upper leg section 64, as shown in FIG. 19). Thus, the fully reclined and fully inclined positions represent the extremes of articulation of bed 10. Bed 10 also permits inclining back section 62 while leaving all of sections 63, 64 and 65 in the generally horizontal position. Alternative embodiments are contemplated wherein bed sections 62-65 may be rotated to any desired position between the fully reclined (66) and fully inclined (67) extremes shown herein. For example, in one embodiment, the fully reclined position may include back section 62 pivoted beyond horizontal so that the patient's head is lowered relative to the rest of his body.

Referring to FIGS. 1 and 8-11, each of back section 62, seat section 63 and upper and lower leg sections 64 and 65 comprises a generally rectangular frame of tubular metal construction, each (except for leg section 64) having opposing side bars 71 and 72 and opposing upper and lower crossbars 73 and 74 extending therebetween. The side bars 71 and 72 and crossbars 73 and 74 are generally of uniform size and shape, which is essentially rectangular box tubing, and in one embodiment, such tubing measuring about 1.5 in.×0.75 in.; each bed section measuring about 35 in. wide; and the head 62, seat 63, upper leg 64 and lower leg 65 sections measuring about 28 in., 10 in., 13 in. and 24 in. long, respectively. Sections 62-65 are provided with additional strength with one or more enlarged crossbars (as at 75) or other members, as needed. The corners 76 of each of back, seat, upper leg and lower leg sections 62-65 are of the same rectangular box tubing as their adjacent sidebars and crossbars, and each has an inner radius of about 2.0 in.

Upper leg section 64 differs from sections 62, 63 and 65 in that instead of a cross bar 74 of about 1.5 in.×0.75 in. in a substantially continuous transition from side bars 71 and 72, upper leg section 64 includes a straight, open-ended sleeve 70 at its rearward end. Sleeve 70 thus forms the housing for the side assist assemblies (as described herein) and is situated generally below the knee and lower thigh of a person lying or sitting on the bed, such as in the egress position 50.

Figure 8:
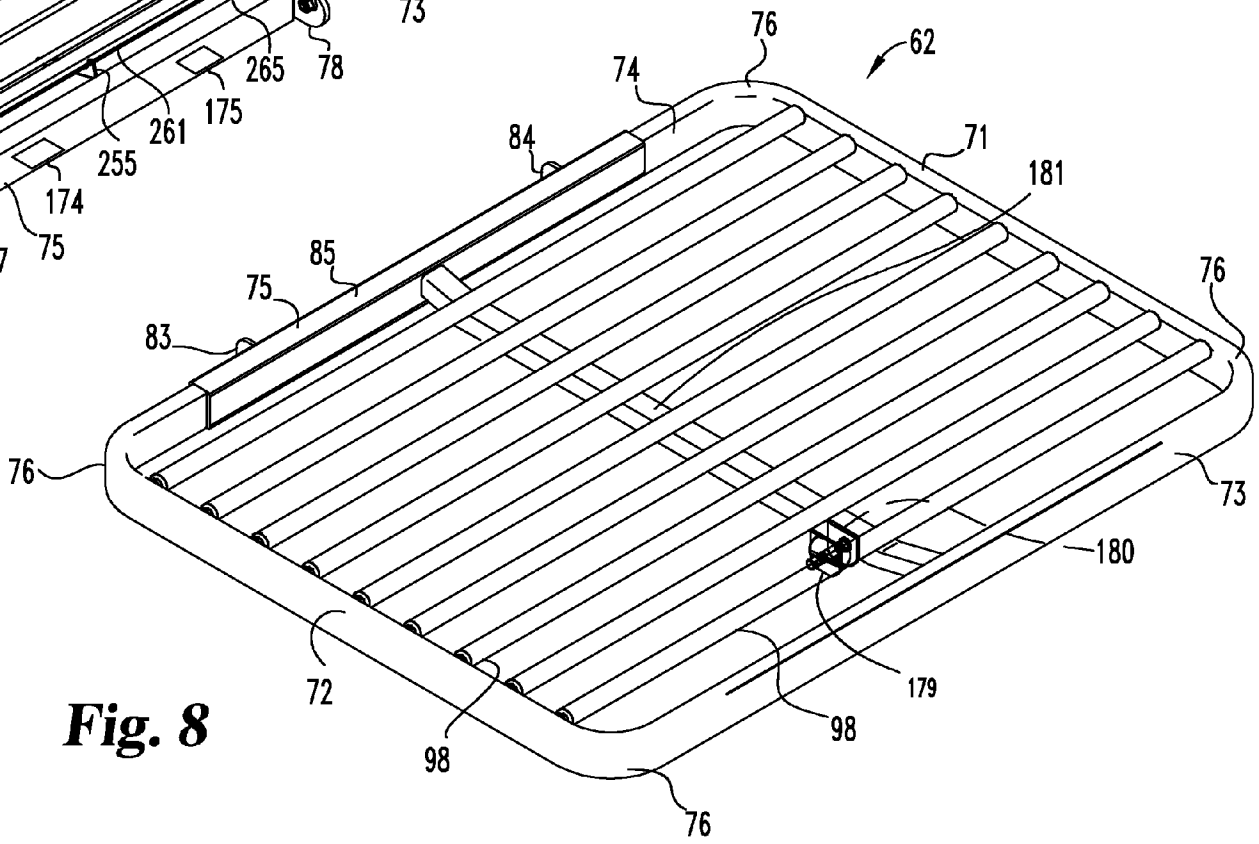
FIG. 8 is a perspective view of back section 62 of the healthcare bed 10 of FIG. 1
Figure 9:
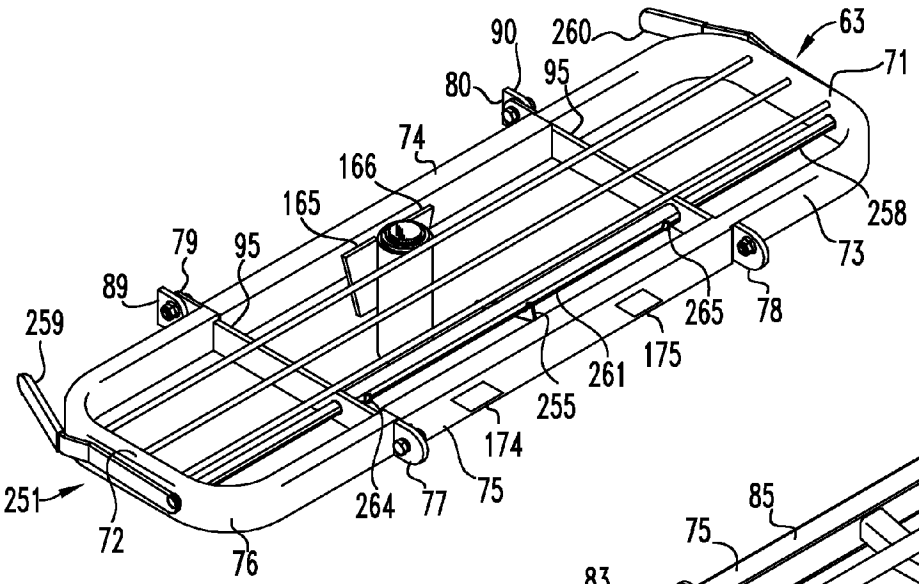
FIG. 9 is a perspective view seat section 63 of the healthcare bed 10 of FIG. 1.

Referring to FIG. 9, seat section 63 includes opposing, forwardly extending hinge plates 77 and 78 and opposing, rearwardly extending hinge plates 79 and 80, respectively. Each of hinge plates 77-78 and 79-80 are rigidly connected to their respective upper and lower crossbars 73 and 74, respectively, of seat section 63, as shown. Referring to FIG. 8, back section 62 includes opposing hinge plates 83 and 84, which are rigidly connected with and extend from enlarged front crossbar 85 of back section 62 for pivoting connection with mating hinge plates 77 and 78, which thus hingedly connects back section 62, along axis 88, to seat section 63. Similarly, upper leg section 64 includes hinge plates 89 and 90 extending rigidly, forwardly from their enlarged upper crossbar 75 for pivotal connection with seat section hinge plates 79 and 80 to hingedly connect upper leg section 64, along axis 91, to seat section 63. All of hinge plates 77-80 and 83, 84, 89 and 90 are rigidly connected at their corresponding crossbars (73, 74) and inside of respective corners 76.

Referring to FIGS. 8-11, bed sections 62-65 include a plurality of mattress support members and mattress positioning members to support and keep mattress panels 92 in position atop their respective bed section members 62-65. For seat section 63 and leg sections 64 and 65, the mattress support members include a plurality of support rods 93 and central crossbars 94 extending between opposing side bars 71 and 72 and various longitudinal support bars 95 that extend between pairs of upper, lower and central crossbars 73, 74 and 94, as shown. For head section 62, the mattress support members include a plurality of rollers 98 mounted for rotation about mutually parallel axes between the opposing side bars 71 and 72.

Referring to the support rods of bed sections 63-65 (FIGS. 9-11), because each of the corners 76 has an inner radius of approximately 2.0 inches, all of the support rods (as at 93) may be mutually identical and be uniformly spaced as close as 2.0 inches apart from each other and from the crossbars 73 and 74. That is, if the corner radii were greater than 2.0 inches and the corresponding end rod (e.g. 99) were to be 2.0 inches from the corresponding crossbar 74, then that end rod 99 would extend not between the opposing, parallel side bars 71 and 72, but would extend between the arcuate corners 78, and such rod 10 99 would have to be shorter than the remaining rods 98. The manufacturing inventory would therefore require at least two different lengths of rods. The present invention contemplates a maximum spacing of 2.0 inches (i.e. not more than 2.0 inches) thus requiring only one, uniform rod length. It is further noted that the cross-sectional size and shape of corners 76 are substantially identical to that of side bars 71 and 72 and of crossbars 73 and 74 (except, of course, for the enlarged crossbars as at 85), with virtually no or no dimpling. Also, as opposed to prior bed frames with generally 90° welded or similar connection between side bars and crossbars, the corners 78 of the present bed sections 62-65 provide a smoother and safer curved contour.

Figure 13:
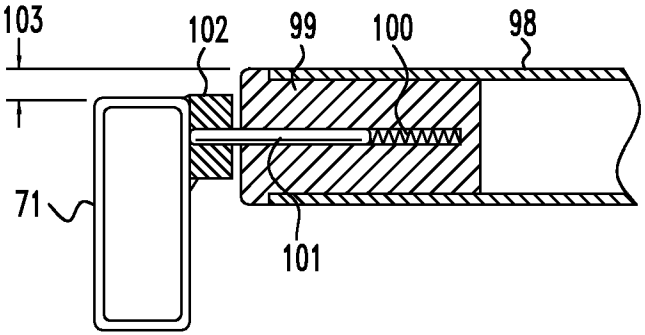
FIG. 13 is side, cross-sectional view of a portion of back section 62 of the healthcare bed 10 of FIG. 1 taken along the lines 13-13 and viewed in the direction of the arrows.
Figure 12:
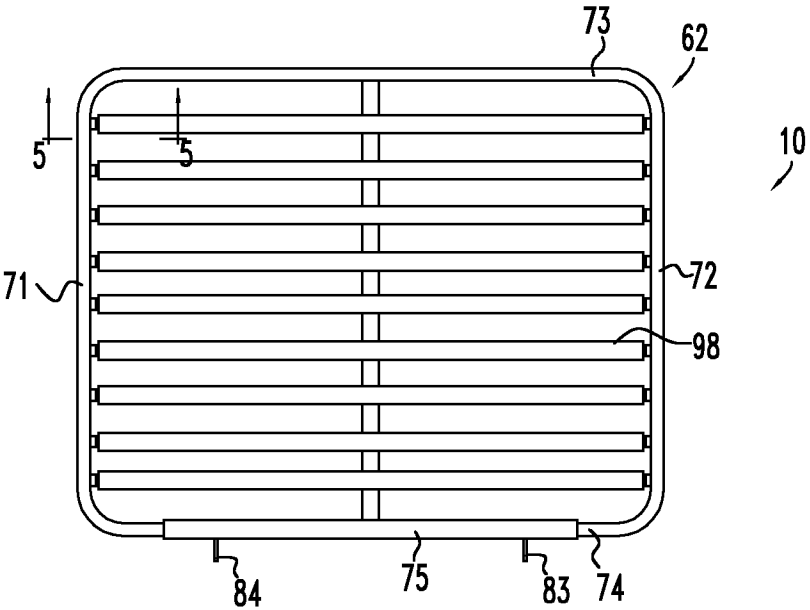
FIG. 12 is a plan view back section 62 of the healthcare bed 10 of FIG. 1.

Referring to FIGS. 8, 12 and 13, the mattress support members for head section 62 include a plurality of rollers 98 mounted for rotation about mutually parallel axes between the opposing side bars 71 and 72. In one embodiment, each roller is 16 Ga. tubing, 1 inch in diameter. The dimensions for various components disclosed herein are for one embodiment, it being understood that the sizes are contemplated to be selected to achieve optimum performance of the healthcare bed 10. A flanged nylon insert 99 is press fit into the opposing ends of the roller 98 and defines a central hole for receiving a spring 100 and a dowel pin 101. Dowell pin 101 is 3/16 in. diameter×1 in. long. Each roller 98 is held for rotation about its axis by roller support discs 102, which are essentially 5/8 in. O.D.×13/64 in. I.D.×1/4 in. thick washers that are fixedly secured to the side bars 71 and 72, as by welding. To mount a roller 98, the dowel pins 101 are pushed inwardly against the spring bias, rollers 98 are positioned between a pair of opposing support discs 102, and the dowel pins 101 are released to extend into corresponding support discs 102, as shown. The support discs 102 are sized and configured and are secured to side bars 71 and 72, and the rollers 98 are sized, so that the rollers extend about 1/4inch above the top of side bars 71 and 72 (and a similar distance above crossbars 73 and 74). The friction coefficient is very low between the nylon insert 99 and the dowel pin 101 to provide a sufficiently free rolling action of each roller 98. Additional lubricant to lower the coefficient of friction therebetween, such as grease, can be used.

Figure 15:
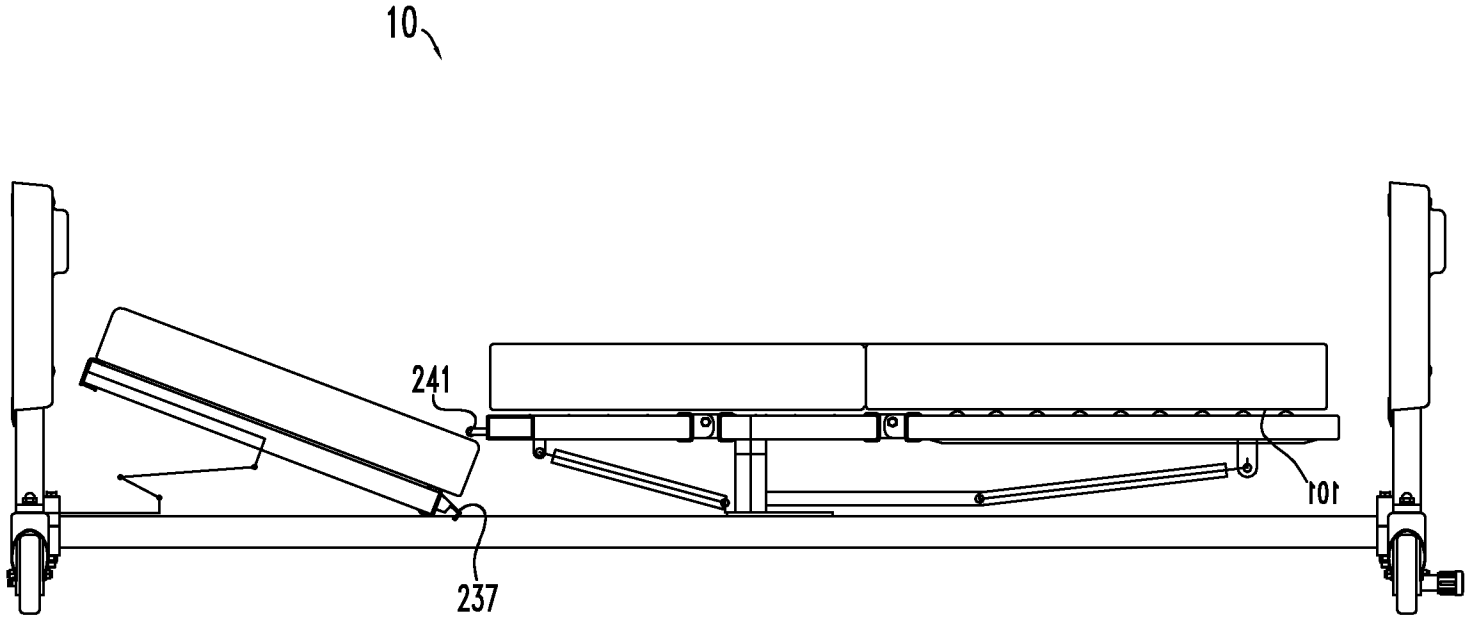

Referring to FIGS. 14 and 15, the mattress panels 92 are shown to include a back mattress panel 105, a seat mattress panel 106 and a lower leg mattress panel 107. There are a wide variety of mattress configurations for healthcare beds, and the present invention contemplates both a bed frame with sections such as at 62-65 and mattress panels 92 having at least two distinct mattress panels, one of which being a lower leg panel 107 and the others being multiple panels (as at 105 and 106). The panels 105-106 are here separately encased, but are connected at their upper surface by a fabric membrane 108 or other connection element so that one mattress panel (i.e. 105) can be hingedly rotated proximal the fabric membrane 108 relative to the adjacently, hingedly connected mattress panel (i.e. 106). Such mattresses are typically manufactured with non-slip surface 109 on their undersides so the mattress will stay positioned atop the bed surfaces 62-65. This non-slip behavior between mattress and bed surface is desired in both the longitudinal (head to foot) and lateral (side to side) directions. Unfortunately, when the back section 62 is articulated from a reclined position 66 to an inclined position 67, the conventional mattress can grip the back section enough to cause one or more of the mattress panels to bind, pinch or otherwise move downwardly or in other undesirable directions.

Figure 17:
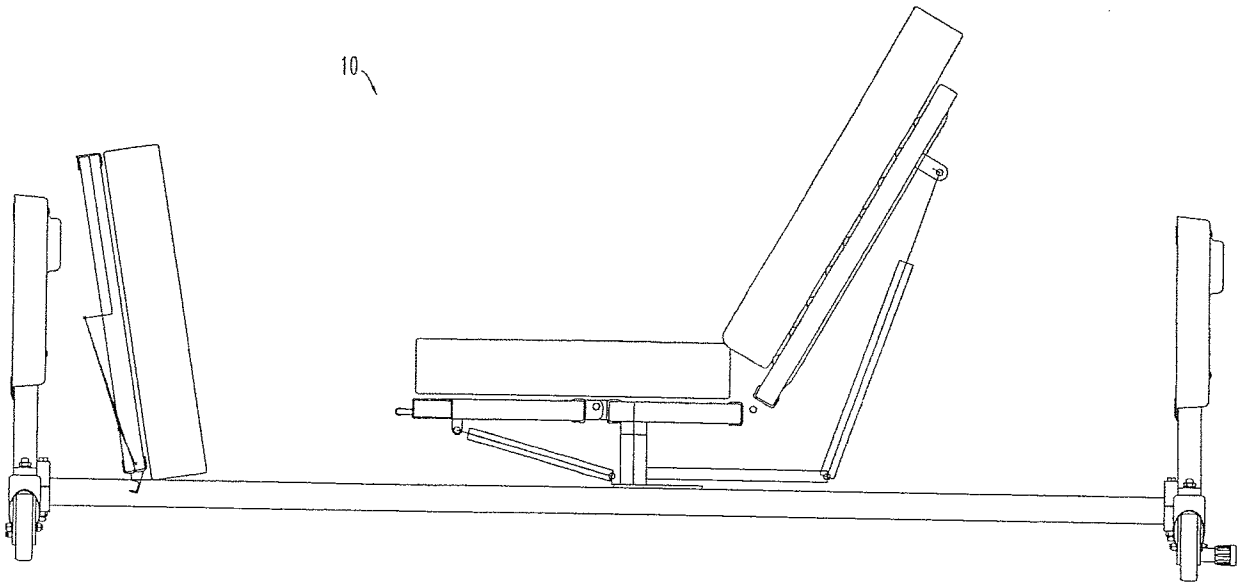

In the present invention, when back section 62 is inclined, the rollers 98 permit the back mattress panel 105 (or the similarly positioned section of any other mattress configuration) to roll atop back section 62 and essentially slide upwardly upon articulation of back section 62, as shown in FIG. 17. Typical mattress panels 92 are about 6 or 7 inches thick, and the hinge joint between back mattress panel 105 and seat mattress panel 106 is typically located some distance toward the foot of the bed, which further permits the back mattress panel 105 to resist binding proximal the hinge membrane 108 and achieve an optimum movement during articulation of back section 12.

Figure 18:
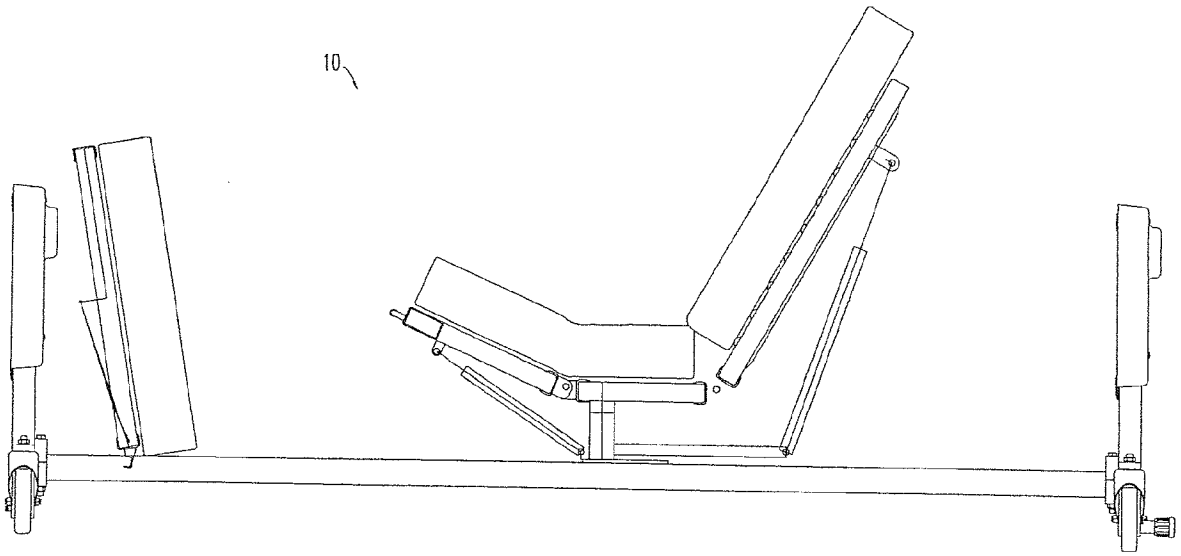

In one embodiment, mattress panels 92 comprise one lower leg panel 107, one back panel 105 and one seat panel 106, the seat panel 106 being sized to cover both the seat section 63 and the upper leg section 64. Even though the upper leg section 64 articulates (bends) relative to seat section 63, seat panel 106 is made of a material and is sized to readily flex atop seat and upper leg sections 63 and 64 when the upper leg section 64 articulates relative to seat section 63 (FIG. 18). In one embodiment, all mattress panels are about 7 inches thick and about 35 inches wide, and panels 105, 106 and 107 are about 32 inches, 23 inches and 26 inches long, respectively. Alternative embodiments are contemplated wherein seat mattress panel comprises two panels, one for each of seat section 63 and upper leg section 64, such panels being contemplated to be joined by a fabric membrane like the membrane 108 between head panel 105 and seat panel 106.

Because the other sections 63-65 have just the rods 93 (that is, no rollers, as in back section 62), there is greater friction between the section 63-65 and the superjacent mattress panels 106 and 107. This has the effect of holding the mattress panels 106 and 107 in place, and only back mattress panel 105 can freely rotate about its hinge membrane 108 and slide up upon back section 62. The reverse effect occurs when back section 62 is rotated back down to the reclined position 66. That is, back mattress section 105 pivots back to a flat position, sliding freely atop rollers 70, to the position shown in FIG. 14.

Figures 10, 11:
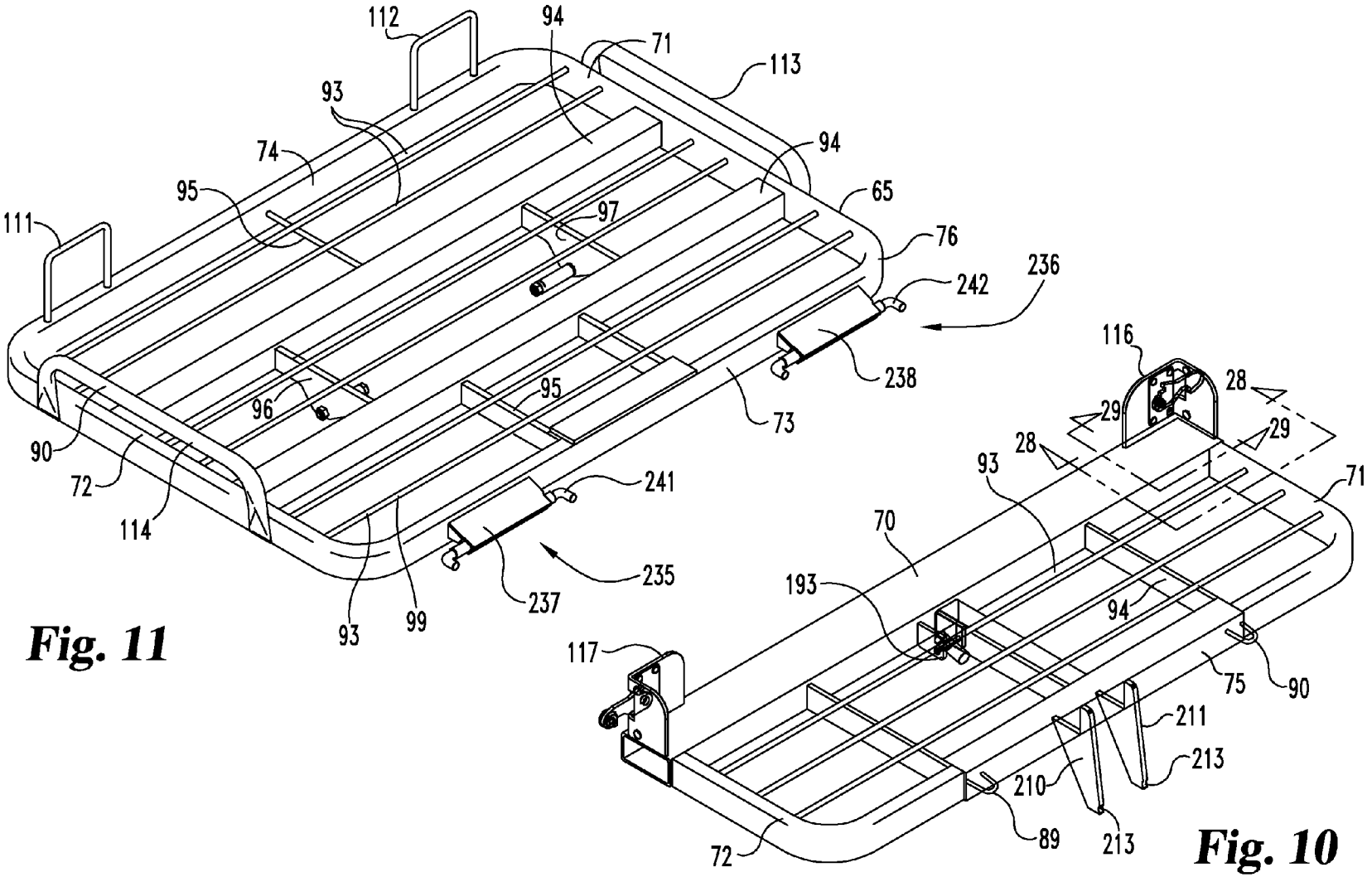
FIG. 10 is a perspective view upper leg section 64 of the healthcare bed 10 of FIG. 1.
FIG. 11 is a perspective view lower leg section 65 of the healthcare bed 10 of FIG. 1.

Referring to FIG. 11, the mattress positioning members for lower leg section 65 include a pair of end loops 111 and 112 and a pair of side rails 113 and 114. End loops 111 and 112 extend upwardly (here meaning generally orthogonally from the plane of lower leg section 65) from lower crossbar 74 of lower leg section 65 and are spaced apart, as shown in FIG. 11. Side rails 113 and 114 extend upwardly (here again, meaning generally orthogonally from the plane of lower leg section 65) from the opposing side bars 71 and 72, respectively. Side rails 113 and 114 extend a substantial portion of the length of lower leg section 65, although each side rail 113 and 114 could be split into more than one rail, like end loops 111 and 112. End loops 111 and 112 each extend upwardly from lower leg section 65 enough to restrain the corresponding mattress panel 107 positioned atop lower leg section 65 from moving both laterally and toward the foot of the bed 10. End loops 111 and 112 also serve as handles a person can grasp and move lower leg section 65 among its various positions, as described herein.

Referring to FIGS. 4, 10, 28 and 29, the mattress positioning members acting on seat mattress panel 106 include corner latch brackets 116 and 117, which also form a part of the right and left assist latch assemblies 119 and 120, described herein. Latch brackets 116 and 117 are L-shaped in plan view and extend upwardly from the rear, opposing corners of the sleeve 70 of upper leg section 64, as shown. The rear (toward the foot of bed 10) end of seat mattress panel 106 nests snugly within the two upstanding latch brackets, restraining it from moving both laterally or toward the foot of the bed 10. If the distance between brackets 116 and 117 is slightly less than the width of seat mattress panel 106, then brackets 116 and 117 will exert a slight degree of grip on seat mattress panel 106. When bed 10 is in the fully reclined position 66 and lower leg section 65 is in a connected position 121 (FIGS. 1 and 3) wherein the forward end of lower leg section 65 is engaged with upper leg section 64 and the two sections 64 and 65 are in a mutually planar, generally horizontal position (and part of the fully reclined position 66), the forward edge of the mattress panel 107 positioned atop lower leg section 65 is nested up against the rear sides 122 of assist latch brackets 116 and 117, which thereby restrain lower leg mattress panel 107 from moving forwardly (toward the head of bed 10).

Figure 4:
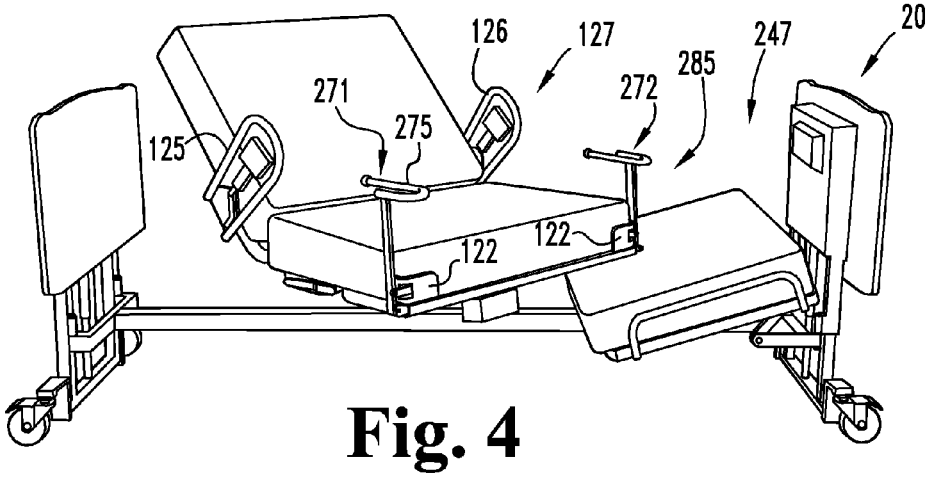

Referring to FIGS. 3 and 4, bed frame 10 further includes opposing left and right side rail assemblies 125 and 126, respectively, (FIGS. 3, 4 and 5) that are connected to the opposing side bars 71 and 72, respectively, of back section 62 and that are operable to be pivoted between an up position 127 (FIG. 4) and a down position 128 (FIG. 3). As used herein, a side rail assembly may also be referred to as a side guard assembly. (One or more intermediate side assembly positions between and/or beyond the extreme positions 127 and 128 are contemplated, but not shown herein). Alternative embodiments are contemplated wherein the side rail assemblies are configured differently than those shown at 125 and 126, as is known in the art. Side rail assemblies 125 and 126 are sized and configured and are connected to side bars 71 and 72 such that the back mattress panel 105 fits snugly between side rail assemblies 125 and 126 and is restrained from moving laterally from its intended position. In the present embodiment, side rail assembly 125/126 forms a loop that, in the up positions 127, extends a useful distance above back mattress panel 105 to restrain patient movement and/or use controls mounted to the loop. The loop is sized and configured so that, in the down position 128, the loop still extends above back section 62 enough to restrain lateral movement of the back mattress panel 105 thereon.

Figure 2A:
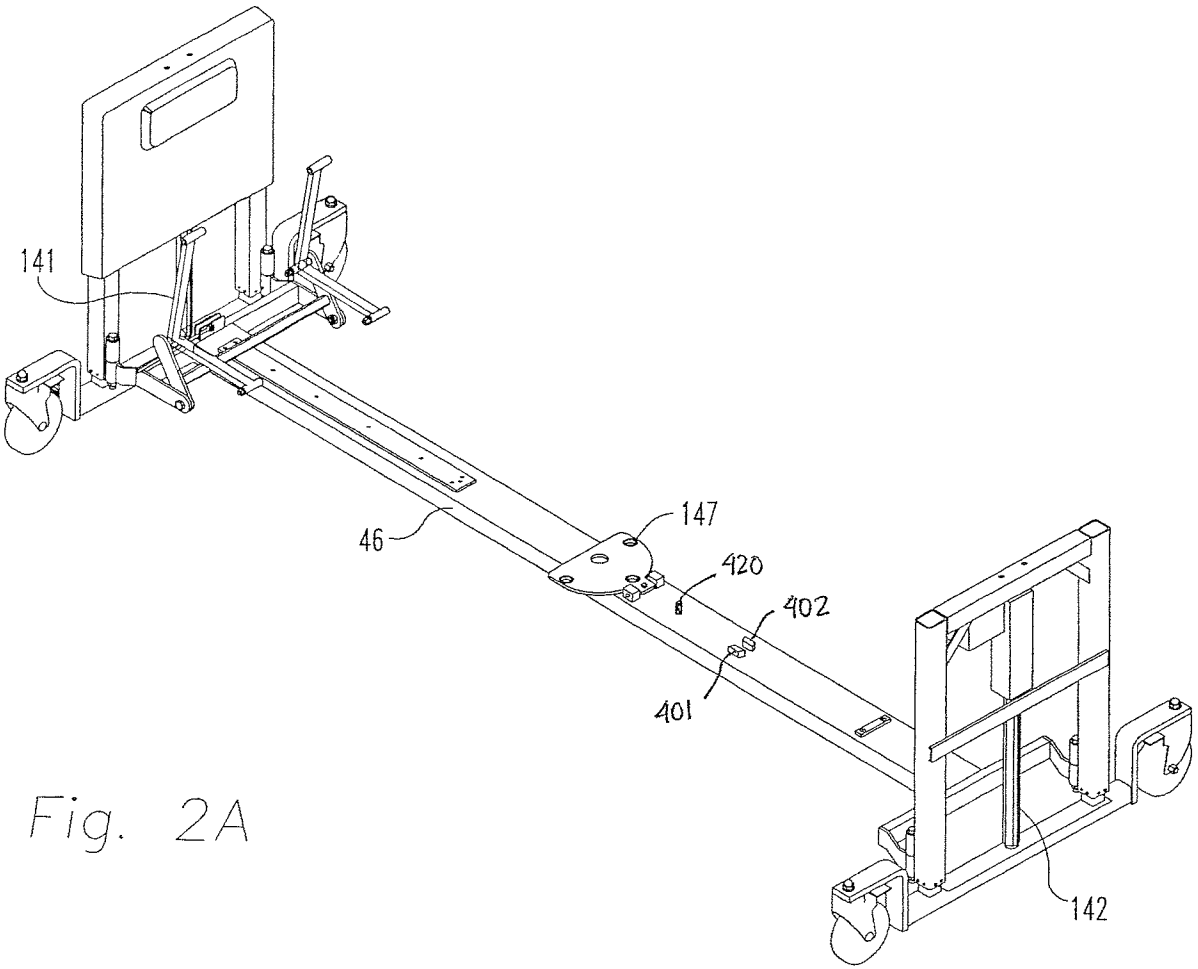
FIG. 2A is a perspective view of the healthcare bed of FIG. 2 and with bed surface pivot assembly 145, and linear actuators 143 and 144 removed.
Figure 20:
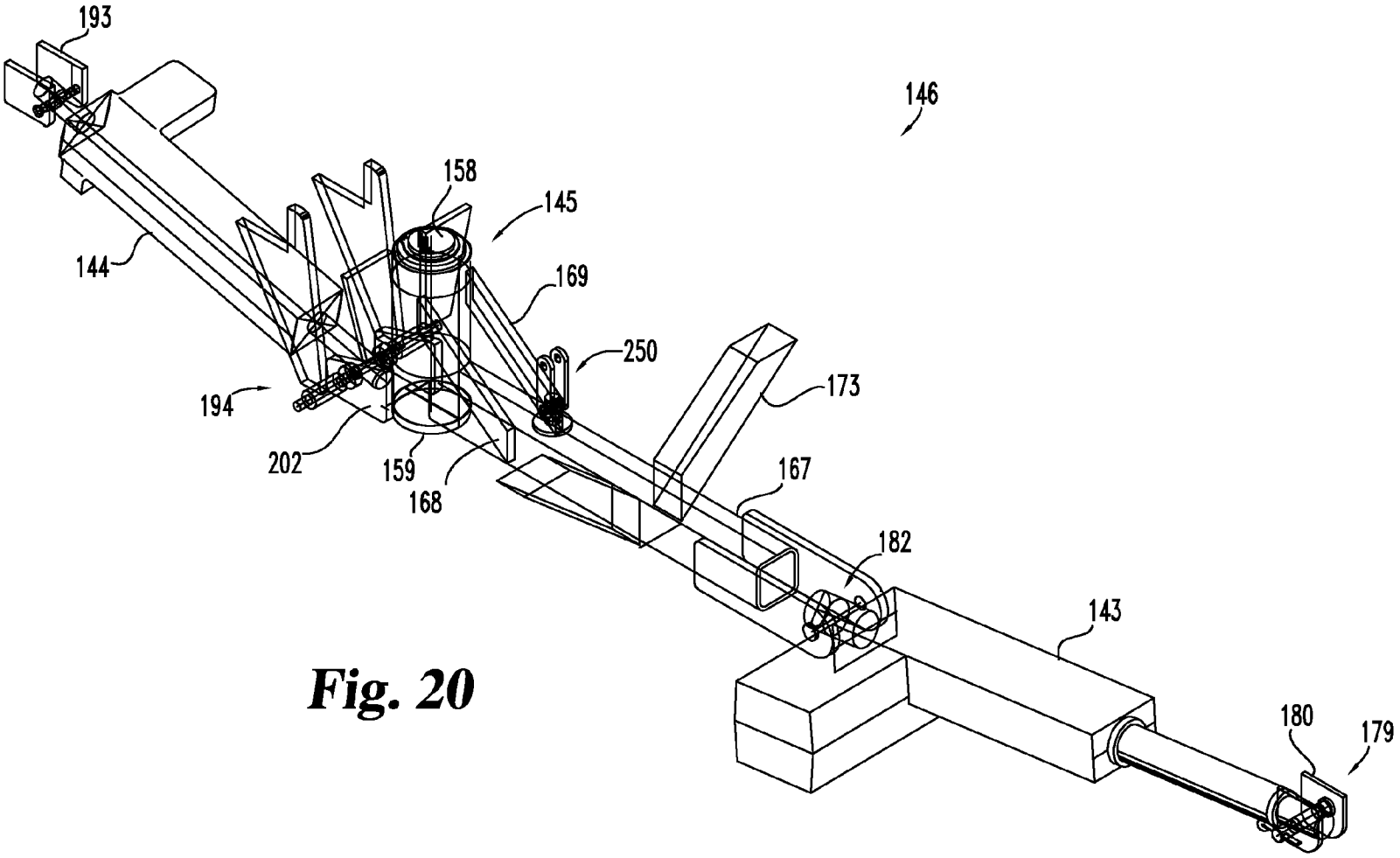
FIG. 20 is a perspective view of the apparatus for moving one or more components of the healthcare bed 10 of FIG. 1.

Referring to FIGS. 2, 2*a* and 20, the apparatus 15 for moving one or more components of bed 10 includes a plurality of linear actuators 141-144 and a bed surface pivot assembly 145. Linear actuators 141 and 142 extend between base members 24 and top members 26 of head stanchion 19 and foot stanchion 20, respectively and, upon actuation raise the head members 26, sleeves 33 and 34 and longframe member 21 relative to base members 24, thus raising the entire bed surface 14, which is connected with longframe member 21, as described.

Linear actuators 143 and 144 and bed surface pivot assembly 145 are combined into one central rotation frame control assembly 146, upon which back section 62, seat section 63 and upper leg section 64 are supported as a unit for rotation and articulation upon the central support rail 46 of longframe member 21.

Referring to FIGS. 2, 2*a* and 20-24, bed surface pivot assembly (pivot assembly) 145 includes a swivel lock plate 147 and a central support axle pivot assembly 148. Lock plate 147 is mounted atop support rail 46 in a location between head and foot stanchions 19 and 20 to provide rotation of articulating bed surface 14 roughly midway between stanchions 19 and 20. Lock plate 147 defines a central axle hole 150, three locking holes 151-153, and two rotation limit mounting holes 154 and 155. Pivot assembly 148 includes an axle 158 and an axle sleeve 159. Axle 158 registers with central axle hole 150 and is coaxially received within axle sleeve 159. Axle sleeve 159 is supported upon a bearing (not shown) upon swivel lock plate 147 and is thus held for rotation about axle 158 atop plate 147.

A stop member (a bolt, pin or other member as at 154/155) is located, one each at the two holes 154 and 155, whereby a pin or other structure of the pivot lock assembly (or articulating bed surface 14) will engage with such member 154/155 and stop articulating bed surface 14 from rotating past the desired left and right egress positions 50.

Axle sleeve 159 is fixedly mounted to seat section 63 (FIG. 9), just inside of and against lower crossbar 74 by appropriate means, such as trapezoidal connection brackets 165 and 166 which are welded to both axle sleeve 159 and the inside (forward side) of crossbar 74, as shown. Axle sleeve 159 is further rigidly connected to seat section 63 via a connection arm 167 that extends forwardly of axle sleeve 159 and is rigidly connected thereto by welding and by angle braces 168 and 169 which extend at an angle between and are likewise welded to axle sleeve 159 and connection arm 167, as shown in FIG. 20. Forward support bars 172 and 173 are rigidly connected as by welding to opposing sides of connection arm 167 and extend upwardly and outwardly therefrom to the underside of the enlarged upper crossbar 75 where they are likewise rigidly connected as by welding at 174 and 175, respectively. Seat section 63 is thus rigidly connected to rotate as a unit with axle sleeve 159 about axle 158.

Referring to FIGS. 2, 8, 20 and 22, linear actuator 143 extends between a pivotal connection 179 at one end at a bracket 180 connected to a central support bar 181 of back section 62 and a pivotal connection 182 at its other end to the forward end of connection arm 167 of pivot assembly 145. The latter connection is made by pivotally connecting the rear post 184 of actuator 143 via a pin 185 to forwardly extending arms 186 and 187, which are rigidly connected to the forward end of connection arm 167, as shown. The output rod 190 of actuator 143 is pivotally connected at its forward end via a pin 191 to the brackets 180. Central support bar 181 extends between upper and lower crossbars 73 and 74, but below rollers 98 so that rollers 98 are not restricted from spinning. Extension and retraction of linear actuator 143 pivots back section 62 between fully reclined position 66 (FIGS. 1, 3 and 14) and fully inclined position (FIG. 18).

Referring to FIGS. 2, 10, 20 and 23, linear actuator 144 extends between a pivotal connection 192 at one end to a bracket 193 connected to the forward end of upper leg section 64 and a pivotal connection 194 at its other end to the lower end of axle sleeve 159. Bracket 193 is fixedly connected as by welding to the underside of upper leg section 64, to both of frame sleeve 70 and an enlarged central crossbar, and the rear post 198 of actuator 144 is pivotally connected via a pin 199 to the bracket 193. The output rod 200 of actuator 144 is pivotally connected at its forward end via a pin 201 to brackets members 202 and 203, which are rigidly connected to axle sleeve 159.

Actuator connection pin 201 extends outwardly on both sides from bracket members 202 and 203 and receives thereon stop cylinders 208 and 209 made of a durable material such as nylon. Two rotation limiting fins 210 and 211 are rigidly connected as by welding to the enlarged crossbar 75 of upper leg section 64 and extend downwardly therefrom toward and rearwardly of (toward the foot) pin 201 and its stop cylinders. The size and configuration of fins 210 and 211 are such that, when upper leg section 64 is in the fully reclined position 66, a forward edge 213 of each fin 210 and 211 is in contact with a corresponding stop cylinder 208 and 209, respectively. Thus, when upper leg section 64 is pivoted by linear actuator 144 about its hinges 89 and 90, fins 210 and 211 rotate away from stop cylinders 208 and 209, and when actuator 144 is actuated to rotate upper leg section 64 back down to its reclined position 66 (e.g. FIG. 1), fins 210/211 contact stop cylinders 208/209, which signals that upper leg section 64 is in the reclined position 66, and no further retracting movement of upper leg section 64 is possible.

Extension and retraction of linear actuator 144 pivots upper leg section 64 between the fully reclined position 66 (FIG. 1) and a leg inclined position 216 (FIGS. 18 and 19). Linear actuators 141-144 are electric, but any suitable apparatus that moves two members toward and away from each other is contemplated.

Figure 26:
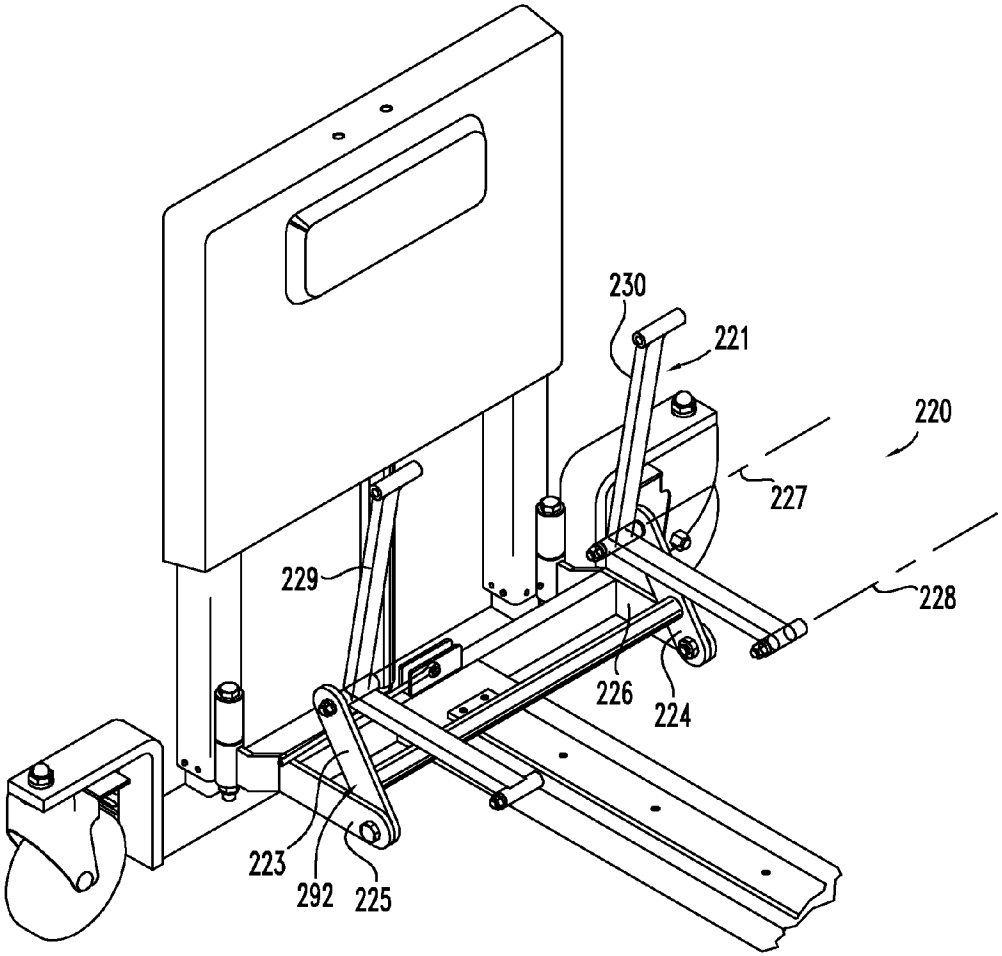
FIG. 26 is an enlarged, perspective view of foot stanchion 20 and the lower leg section connector assembly 220 of the healthcare bed 10 of FIG. 1.

Referring to FIGS. 11 and 26, lower leg section 65 is pivotally connected to support rail 46 and foot stanchion 20 via a lower leg section connector assembly 220 including an upper link member 221 and a lower link member 222. Lower link member 222 includes a pair of spaced apart lower link arms 223 and 224 that are pivotally connected to the forward ends of support rail foot arms 225 and 226, that are rigidly connected to support rail 46 and foot stanchion 20, as shown. Upper link member 221 comprises two upper link arms 229 and 230 that are pivotally connected at one end to the outer ends of arms 223 and 224 and at their opposite, outboard ends are connected to longitudinal support bars 96 and 97 of lower leg section 65 (FIG. 11) The axis of connection between arms 223/224 and arms 225/226 is parallel to the axis of connection 227 between upper link member 221 (arms 229/230) and lower link member 222 (arms 223/224), which is parallel to the axis of connection between upper link member 221 (arms 229/230) and lower leg section 65 (at 96/97). The sizes and configurations links of link members 221 and 221 and the juxtaposition of their connections connecting lower leg section 65 to support rail 46 permit lower leg section 65 to articulate through a variety of positions, as shown and described.

Referring to FIGS. 11, 14, 14*a* and 15, at its upper end, the upper crossbar 73 of lower leg section 65 is releasably connected to the sleeve 70 of upper leg section 64 via a pair of hook and loop members 235 and 236. A pair of hooks 237 and 238 extend outwardly and downwardly (here meaning vertically down) from upper crossbar 73 of lower leg section 65, and a mating pair of loops 241 and 242 extend outwardly (toward the bed foot) from sleeve 70 of upper leg section 64 (loops 241 and 242 are shown in engagement with the hooks and with lower leg section 65 in FIG. 11 rather as they would not otherwise be visible with the upper leg section 64 shown in FIG. 10). The hooks 237 and 238 are sized and configured to be positioned over and engage with loops 241 and 242, respectively, to easily link the upper crossbar 73 of section 65 with the sleeve 70 of section 64.

Figure 16:
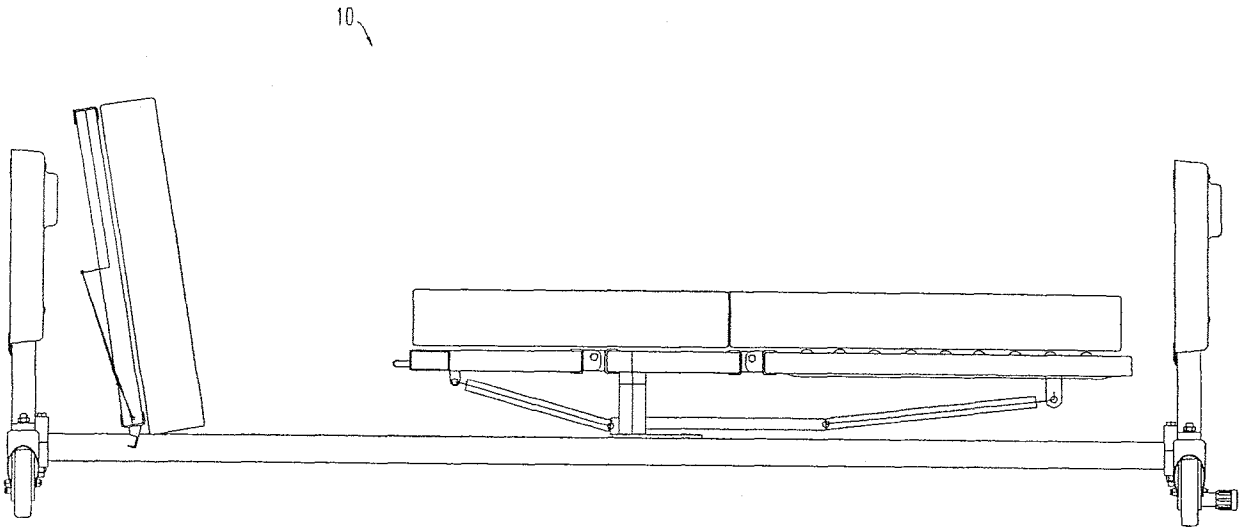

Articulating bed surface 14 comprises back section 62, seat section 63 and upper leg section 64, which are pivotally, but non-releasably connected together. (Non-releasably here means they are not connected in such a way as to facilitate their mutual disconnection without tools, as opposed to the connection between upper and lower leg sections 64 and 65, which can be disconnected from each other to rotate articulating bed surface 14 from its home position 218 to its egress position 50 (or any other position in between) by lifting lower leg section 65 proximal its upper crossbar 73. After such lifting and disengagement of lower leg section 65 from upper leg section 64, lower leg section 65 is then folded via links 221 and 222 toward and against the foot stanchion 20—its rest position 247 (FIGS. 4 and 16). The home position is characterized by bed surface 14 being rotated in alignment with support rail 46 and lower leg section 65. The egress position is characterized by the bed surface being rotated approximately 90 degrees therefrom, either direction, to enable the bed occupant to more easily stand and dismount bed 10, as described. Alternative embodiments are contemplated wherein the limits of rotation may be other than 90 degrees, for example the limits may enable rotation more in one direction than the other. Toward this end, alternative embodiments are contemplated wherein swivel plate 147 is provided with a means for limiting the degree and direction of rotation by any appropriate means such as an upstanding, changeable pin that obstructs rotation by one or more components of central support axle pivot assembly 148 or components in close proximity thereto.

Figure 5:
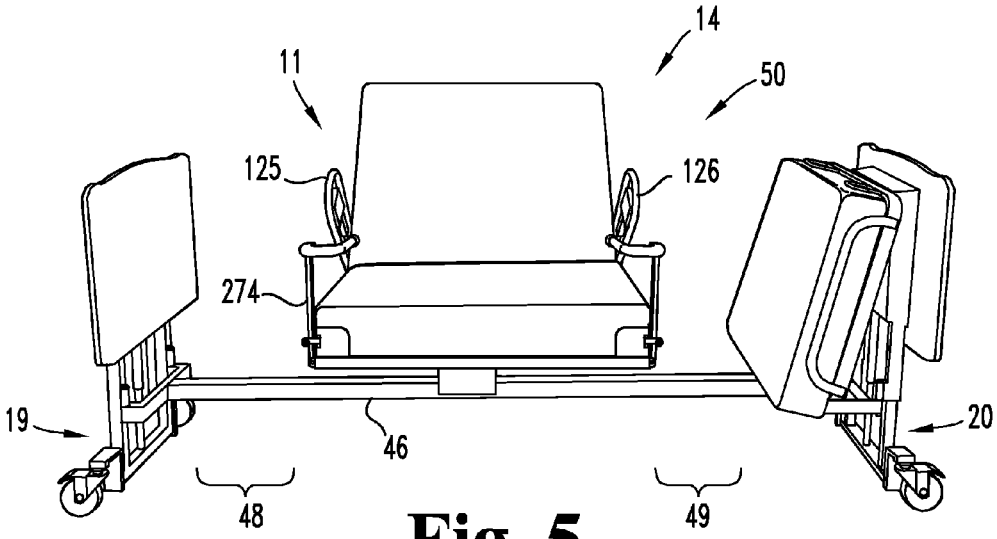
Figure 6:
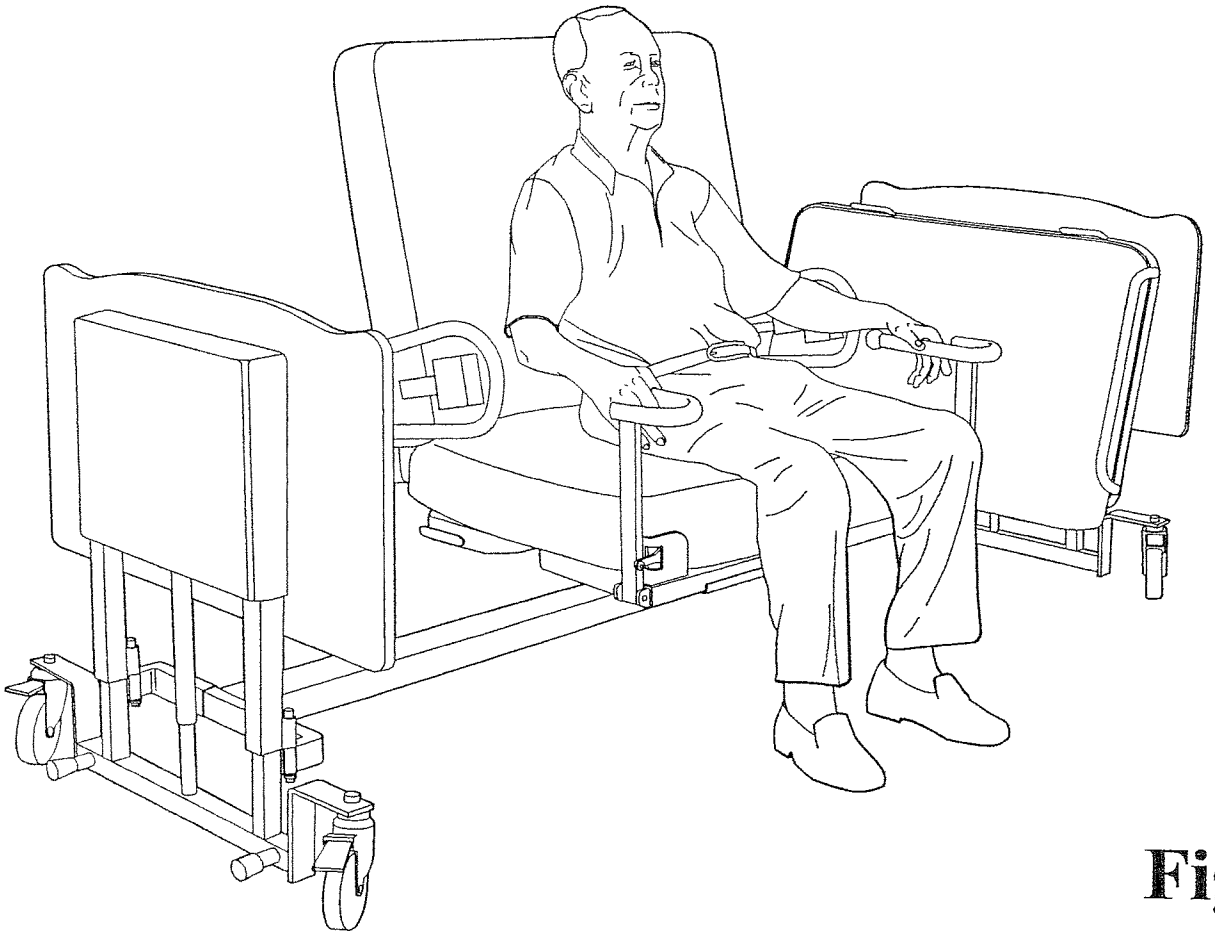
Figure 7:
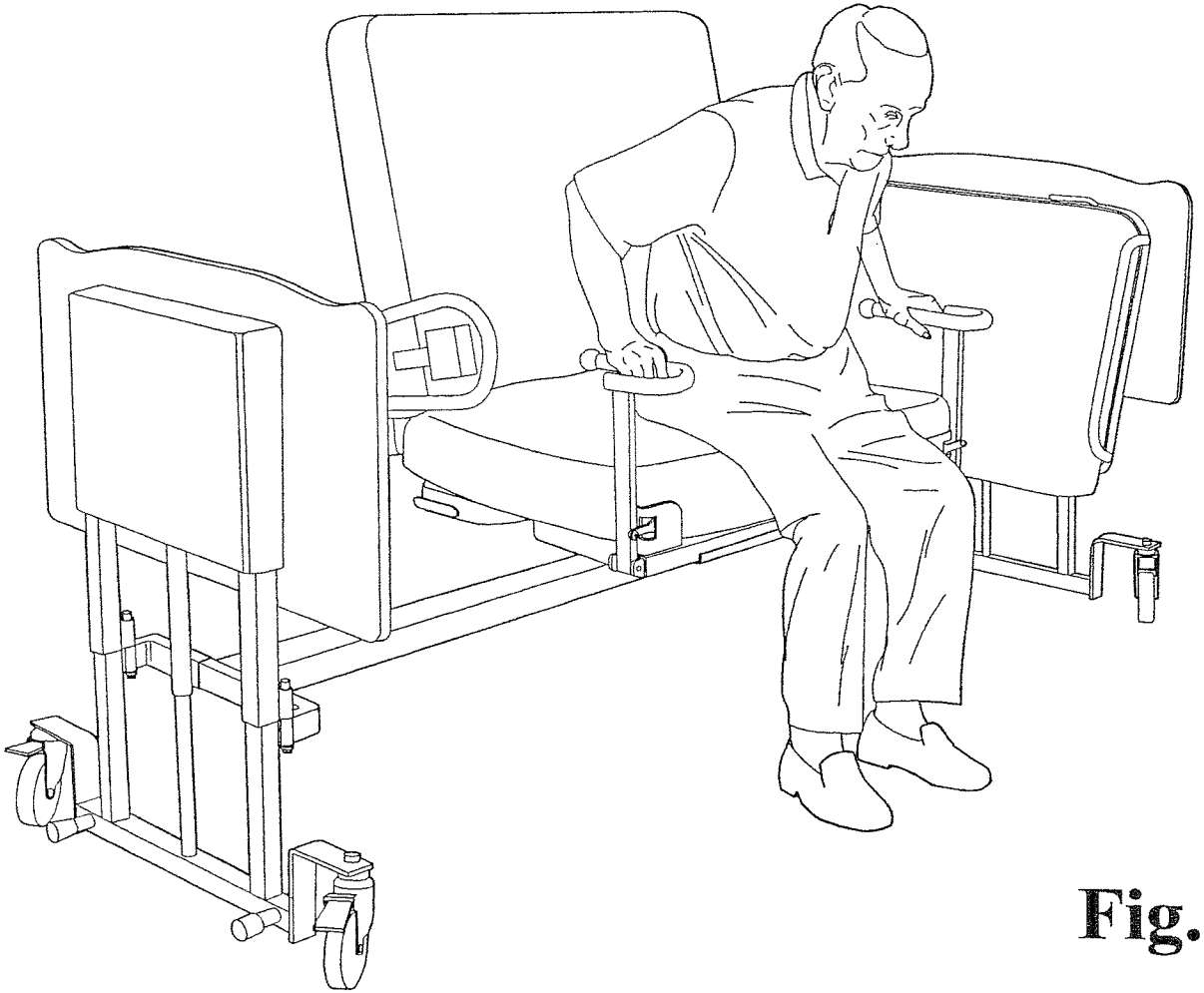
Figure 24:
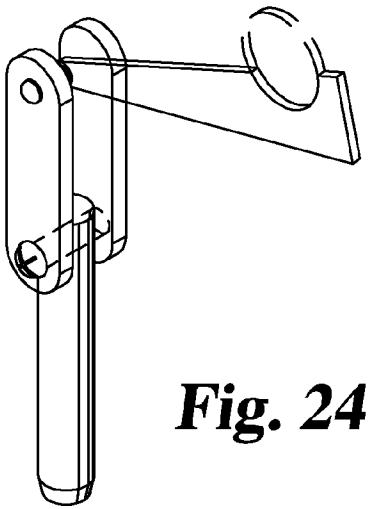
FIG. 24 is perspective view of the lock pin assembly 250 of the rotation locking mechanism of the healthcare bed 10 of FIG. 1.
Figure 21:
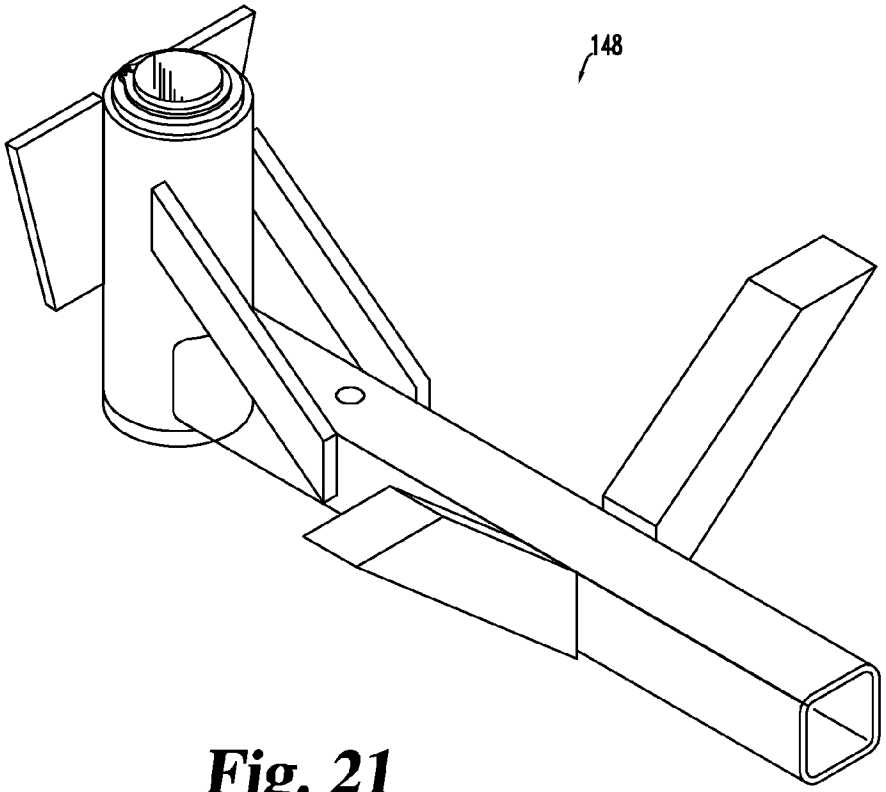
FIG. 21 is a perspective view of the bed surface pivot assembly of the apparatus for moving one or more components of the healthcare bed 10 of FIG. 20.
Figure 22:
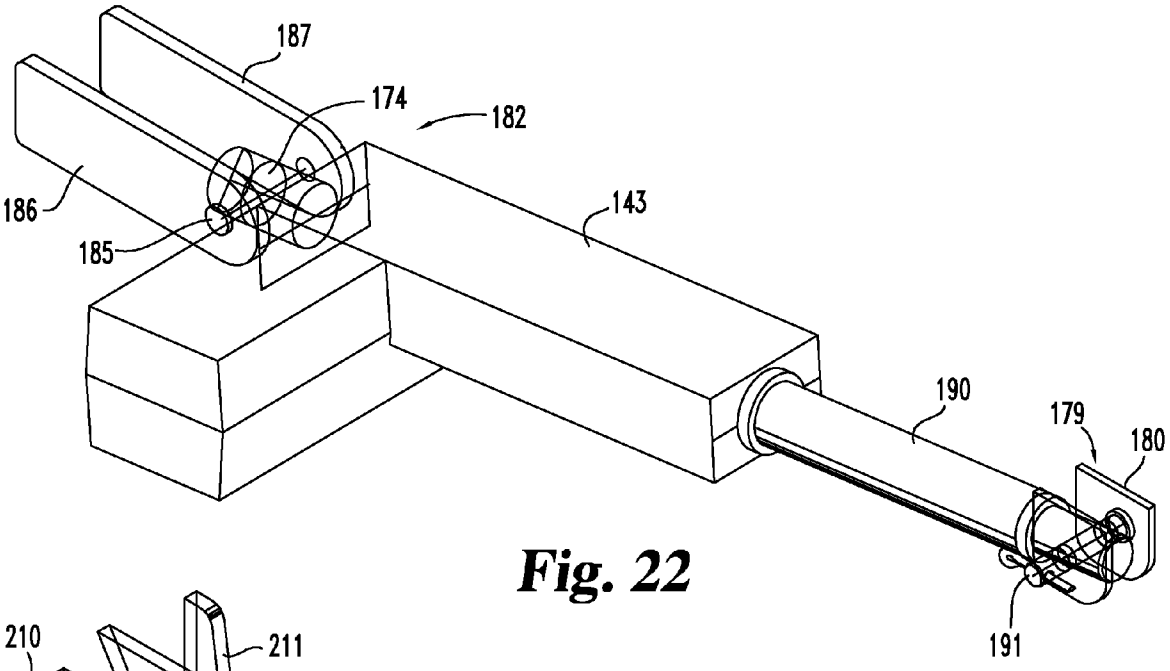
FIG. 22 is a perspective view of the linear actuator 143 of the apparatus for moving one or more components of the healthcare bed 10 of FIG. 20.
Figure 23:
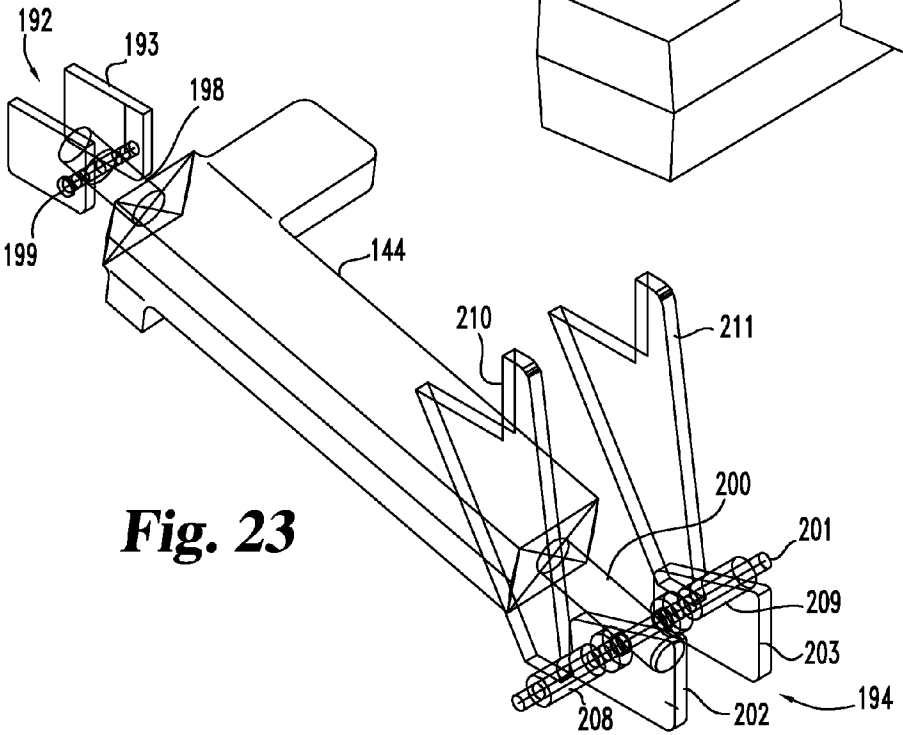
FIG. 23 is a perspective view of the linear actuator 144 of the apparatus for moving one or more components of the healthcare bed 10 of FIG. 20.

Referring to FIGS. 2*a*, 9, 20, 24 and 24, bed 10 further includes a rotation locking mechanism that includes swivel plate 147 (FIGS. 2*a* and 25), connection arm 167 (FIG. 21) of pivot assembly 145, a lock pin assembly 250 (FIGS. 20 and 24), and a handle assembly 251 (FIG. 9). Lock pin assembly 250 includes a lock pin 252, connector links 253 and 254 and a lift arm 255. Handle assembly 251 includes a rod 258 extending through aligned holes in side bars 71 and 72 and longitudinal support bars 95 of seat section 63. A small portion of rod 258 extends outwardly from each of side bars 71 and 72 and a handle 259/260 is fixedly connected, one each to such protruding ends so that rod 258 and handles 259 and 260 rotate as a unit. Disposed between the two longitudinal support bars 95 of seat section 63 is a sleeve 261 through which rod 258 extends. Screws 264 and 264 lock sleeve 261 to rotate with rod 258. One end of lift arm 255 of the lock pin assembly 250 is fixed to rotate with sleeve 261 (FIG. 9 and represented at 261 in FIG. 24). Its opposite end is rotatably mounted to the upper ends of connector links 253 and 254. The lower ends of links 253 and 254 are rotatably connected to the top end of lock pin 252. As assembled, lock pin 252 is suspended from lift arm 255, its lower end extending through a hole 263 defined in connection arm 167 and down to the top of swivel plate 147. When articulating bed surface 14 is in the home position 218, lock pin 252 registers with and extends into the central locking hole 152, which prevents connection arm 167 and all of the connected components—particularly articulating bed surface 14 supported thereabove—from rotating away from the home position 218. Rotation of either handle 259 or 260 will rotate rod 258, sleeve 261 and lift art 255, thus lifting pin 252 out of hole 152, and articulating bed surface 14 can now freely be rotated away from home position (FIG. 4). If rotated 90 degrees either direction, lock pin 252 will fall into a corresponding one of holes 151 or 153, and articulating bed surface 14 will be locked in thereat in one of the egress positions 50 (e.g. as shown in FIGS. 5-7). A spring is connected to bar rod 258 or any other appropriate part of rotation locking mechanism to bias lock pin vertically down so that it will automatically fall into a corresponding one of locking holes 151-153 when articulating bed surface 14 is rotated among the home and left and right egress positions.

Referring to FIGS. 3-7, 10 and 25-27, healthcare bed 10 further includes side assist assemblies to assist the user in both lying in the bed and entering and exiting the bed. One embodiment of such side rail assemblies is shown in FIGS. 3-7. Side rail assemblies 271 and 272 in FIGS. 3-7 are identical except for the left and right versions of the J-shaped hand rail 175 and only one side rail assembly 271 will thus be described. Side rail assembly 271 includes hollow sleeve 70 of upper leg section 64, a support bar 274, and hand rail 275, a slider 276, a home position latch mechanism 277, a hand rail pivot assembly 279, and a hand rail locking assembly 280. Sleeve 70 is the lower crossbar 74 of upper seat section 65 and sized and configured to receive the slider 276 of hand rail pivot assembly 271 therein. Slider 276 comprises an opposing pair of bars with a crossbar 281 extending therebetween, Appropriate bushing members 290 are provided as desired facilitate the smooth sliding action of slider 276 within sleeve 70. At the outer end of slider 276, the lower/inner end of bar 274 is pivotally mounted via a pin 284 (the hand rail pivot assembly 196) to allow bar 274 to rotate between vertical and horizontal positions 285 and 286. Bar 274 is sized to also be telescopically received within hollow sleeve 70. Hand rail 275 is shaped as shown in FIGS. 2-6, that is with a generally J-shape extending first rearwardly (toward the foot of bed 10) from its rigid and fixed mounting to the upper/outer end of bar 274, then curving inwardly and back forwardly (toward the head of bed 10). This permits the user to comfortably grasp the hand rail 275 both when fully seated on the bed and pulling forward and also when sitting down or dismounting from the bed 10 (FIG. 7). A ball member 287 is fixed to the distal end of the hand rail.

Figure 27:
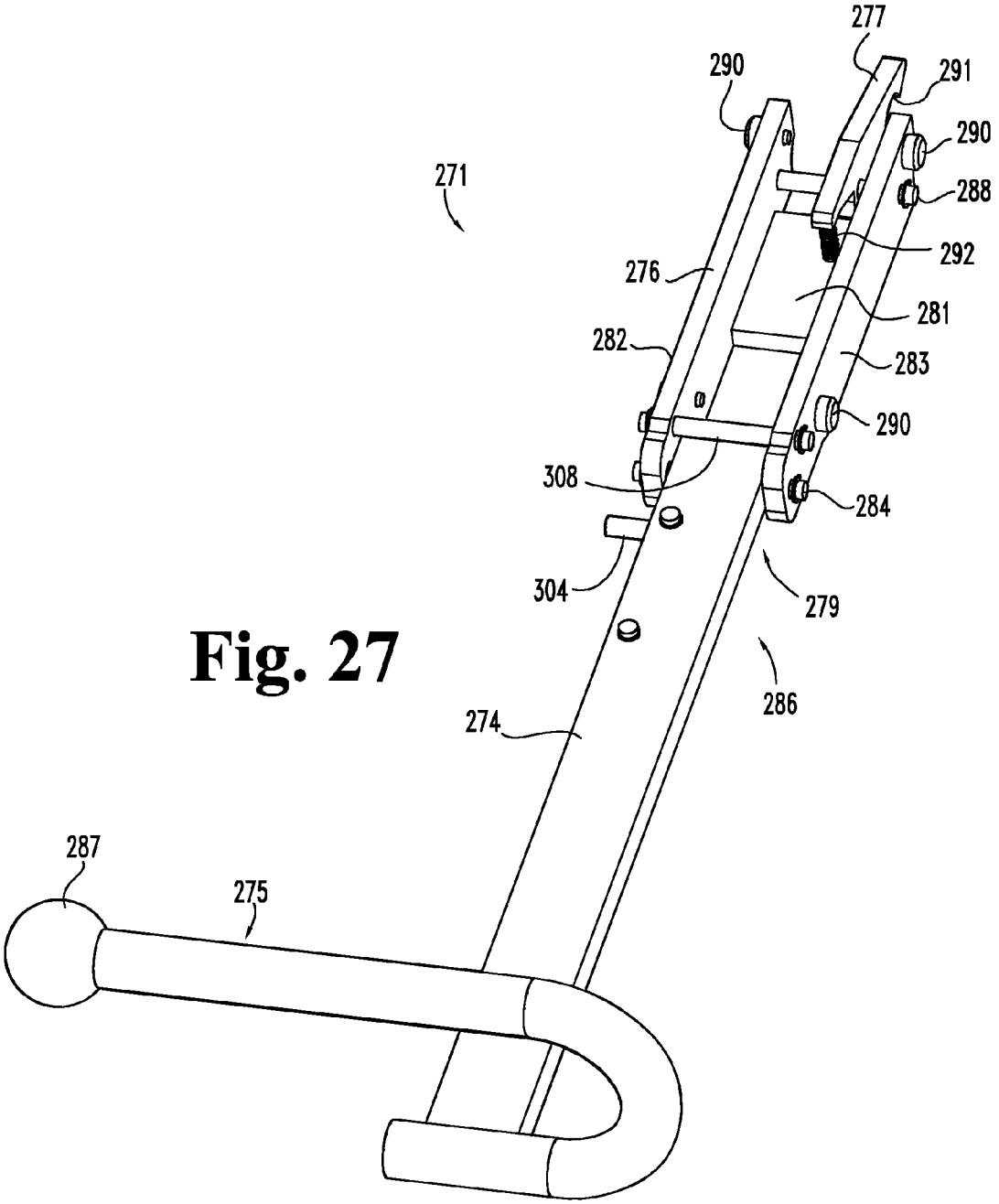
FIG. 27 is a perspective view of a hand rail assembly 271 of the healthcare bed 10 of FIG. 1.
Figure 27A:
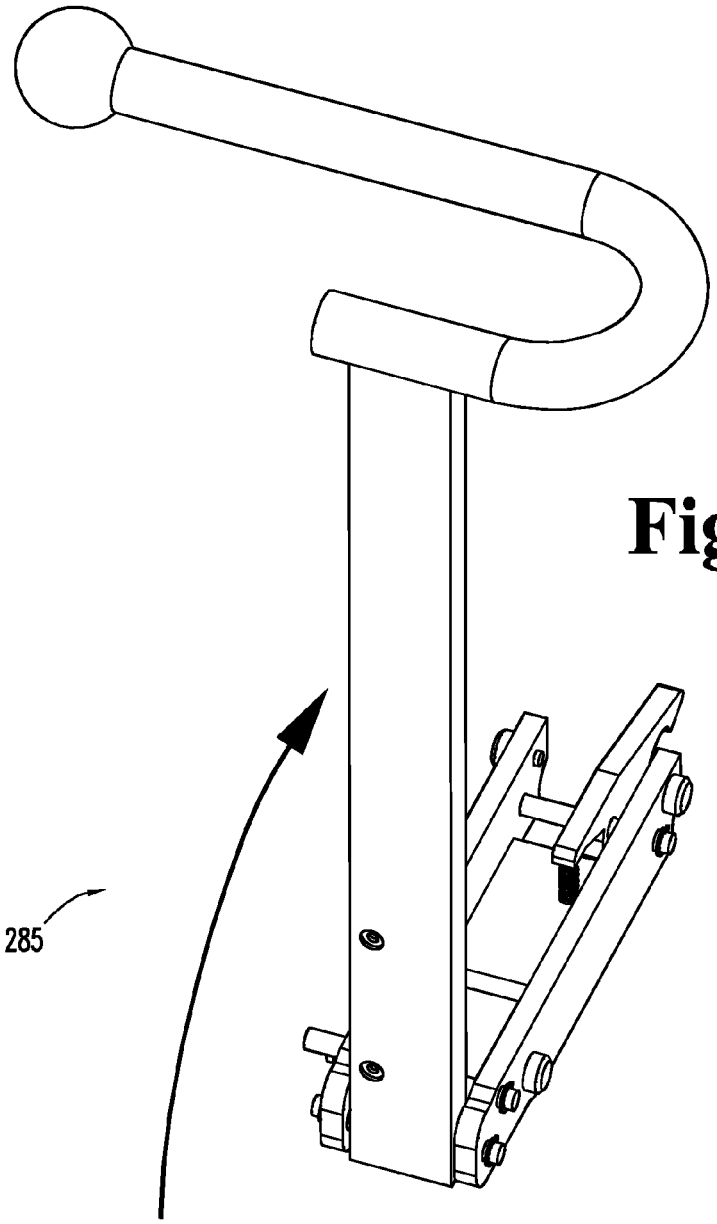
FIG. 27*a* is a perspective view of a hand rail assembly 271 of FIG. 27, but shown pivoted up to the use position.
Figure 28:
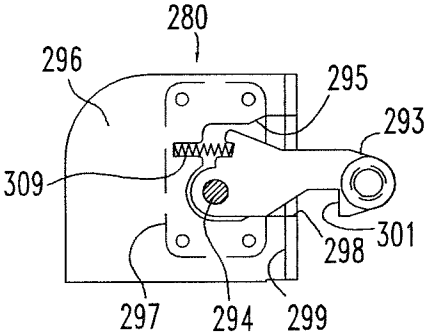
FIG. 28 is a plan view of a hand rail locking assembly 280 of a side rail assembly 271 of the healthcare bed 10 of FIG. 1 and with the inner cover plate removed.
Figure 30:
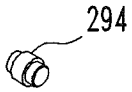
FIG. 30 is a perspective view of the pin 294 about which latch member 293 is mounted for rotation in the hand rail locking assembly of FIG. 28.

Pivotally mounted about a pivot pin 288 between opposing plates 282 and 283 is the home position latch mechanism 277. At its inward end, latch mechanism defines a downwardly opening recess 291. A spring 292 positioned between cross-bar 281 and outward end of latch mechanism 277 biases latch mechanism 277 to pivot clockwise as viewed in figure Hand rail locking assembly 280 includes mirror image latch assemblies 291 and 292 that incorporate the assist latch brackets 116 and 117 mounted to the rear, outer corners of the tops of upper leg section 64 (FIG. 10). Referring to FIG. 28, latch assembly 291 includes a latch member 293 pivotally mounted by a latch pin 294 in a shaped cutout 295 defined in latch bracket 116 so that latch member 293 is coplanar with the rear wall 296 of latch bracket 116 and extends laterally out a cutout opening 298 in the side wall 299 of latch bracket 116. Cover plates (removed in FIGS. 28 and 29, but the shape of which is shown at 297) are juxtaposed and connected with each other on opposing sides of rear wall 296 to sandwich latch member 293 in its cutout 295. Side wall 299 is generally orthogonal to rear wall 295. The outer end of latch member 293 has a downwardly opening hook shape 301 configured to engage with an outwardly extending latch post 304 of support bar 274 (FIG. 27). In use, slider 276 is received within sleeve 70 and slides all the way in until nearly all of bar 274 is received within sleeve 70 and hand rail 275 is disposed up against upper leg section 64 (FIG. 3) and wherein the downwardly opening recess of latch mechanism 277 rides over a longitudinally extending post (not shown) disposed within sleeve 70, midway between its opposing ends. This registration of latch mechanism 277 with the post inside sleeve 70 holds the side rail assembly in position against inadvertent bumping and until a moderate amount of lateral pulling force is exerted to dislodge latch mechanism 277 from the inner sleeve post against the bias of spring 292.

When hand rail 275 is pulled laterally outward, a stop member (not shown) extending from sleeve 70 engages with slider 276 prevents assembly 271 from being pulled out all the way, but instead only far enough for bar 274 to clear the outer edge of sleeve 70, whereupon it can be pivoted roughly 90 degrees about pin 284. A bar stop extends between opposing plates 282 and 283 to prevent bar 274 from pivoting any more than about 90. At the 90 degree, up position, latch member 293 engages with latch post 304 to hold bar 274 firmly up whereupon the person in the bed (which is in the egress position 50), can grasp and exert considerable force thereon to pull and rise to a standing position (FIGS. 5 and 7). A spring 309 biases the hook 301 of latch member downwardly to stay in the locked position. Manually pulling up on the outer end to the latch member 293 will pivot the latch member 293 and allow bar 274 to be pivoted back down and stowed in sleeved 70.

Figure 31:
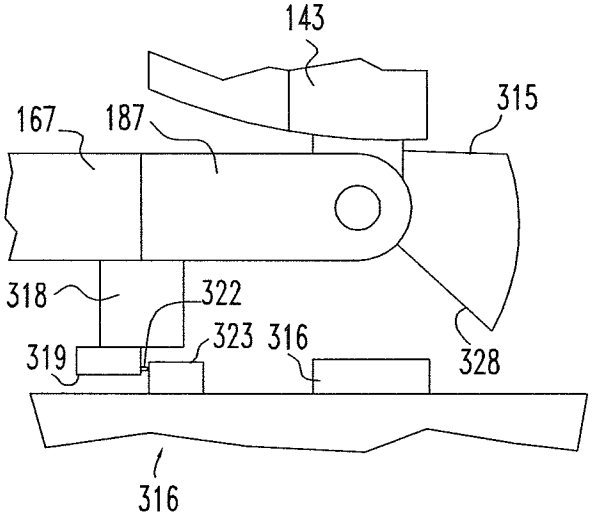
FIG. 31 is a side, elevation view of a portion of the electromechanical interlock mechanism of the healthcare bed 10 of FIG. 1.
Figure 29:
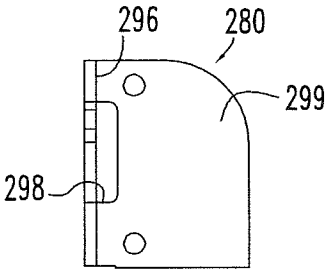
FIG. 29 is a plan view of the hand rail locking assembly 280 of FIG. 28 shown ninety degrees therefrom.
Figure 32:
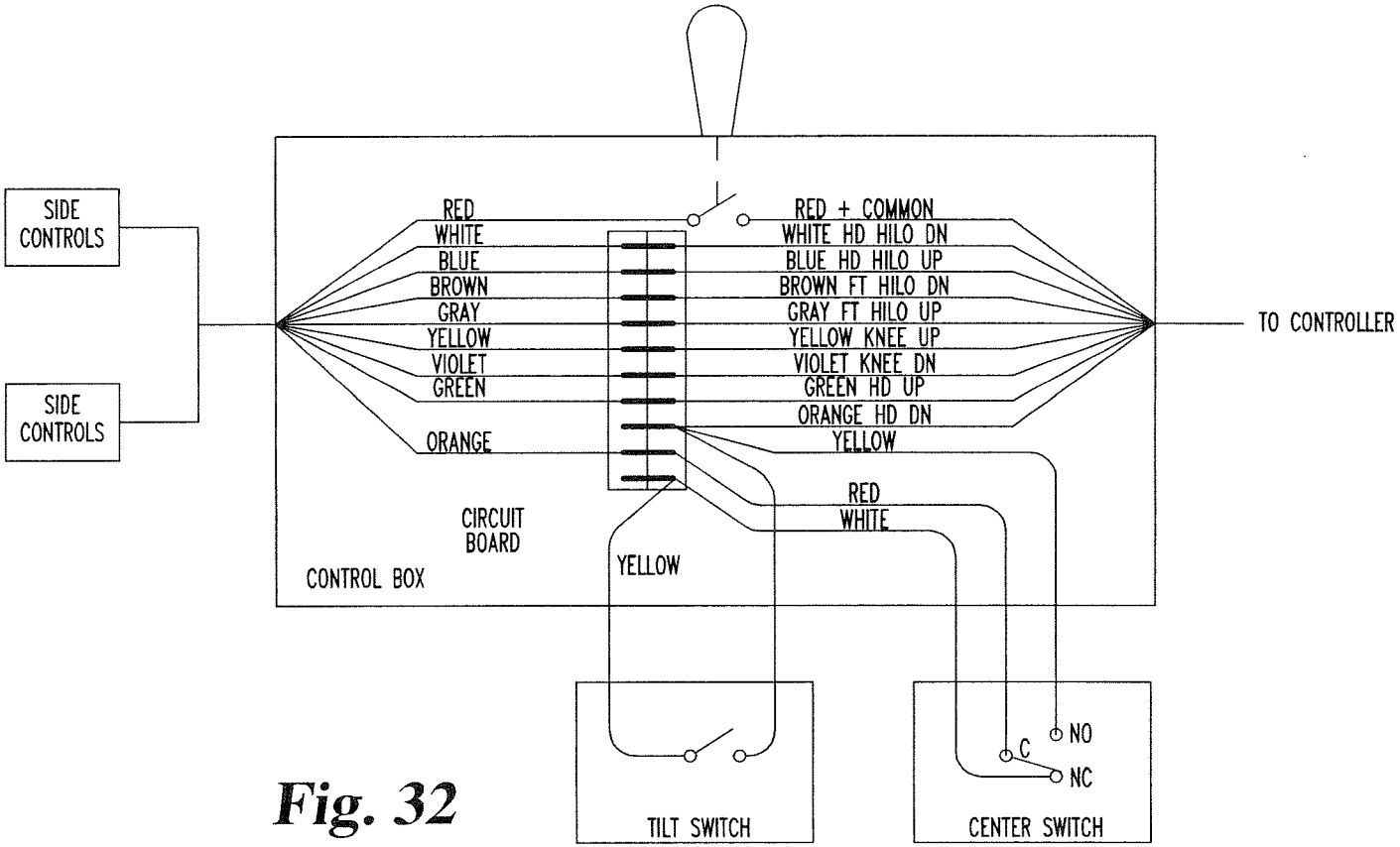
FIG. 32 is schematic showing the circuitry of the electromechanical interlock mechanism of the healthcare bed 10 of FIG. 1.

Bed 10 is also provided with an electromechanical interlock system 400 that prevents rotation of articulating bed surface 14 away from the home position if back section 62 is not inclined to at least a certain degree, in one embodiment about 45 degrees. The interlock system 400 also acts, when articulating bed surface 14 is rotated away from home position (and back section 62 is therefore inclined due to the first function of interlock system 400, to prevent back section 62 from being pivoted back down the horizontal, reclined position. Interlock system 400 includes a pair of stop blocks 401 and 402 mounted atop support rail 46, blocks 401 defining a gap therebetween, and a locking tab 315 fixedly connected with the rear post 184 of the linear actuator 143, which pivots back section 62. Locking tab 315 has the shape shown in FIG. 31 with a curved outer end that clears the top of the support rail 46. It terminates along an edge 328 that, when actuator 143 rotates clockwise, pulling back section 62 toward the reclined position, locking tab 315 enters the gap between stop blocks 401 and 402, articulating bed surface 14 will be mechanically prevented from rotating. A mercury tilt switch (not shown) is connected with back section 62 so that when back section 62 is rotated up, and locking tab 315 clears blocks 401 and 402, the electrical circuit (FIG. 32) switch control over to prevent lowering of back section 62 until articulating bed surface 14 is rotated back to the home position. Also provide is a centering indicator 316 that includes a contact block 319 that is connected with connection arm 167 to articulating bed surface 14. When articulating bed surface 14 is rotated to its home position aligned with support rail 46, block 319 engages a push button sensor at 322 of sensor 323, which signals the electronic control mechanism of bed 10 that articulating bed surface 14 has returned to the home position.

The combination in bed 10 of the ability to rotate the articulating bed surface 14 ninety degrees and safely lock bed surface 14 thereat and then to raise and lower bed surface 14 via linear actuators 141 and 142 provides a unique configuration whereby the user can, without getting up from the bed, enjoy a seated position for eating, reading, watching television or socializing. Once rotated, the bed can be vertically adjusted so that the occupant can place his/her feet on the floor for a more comfortable sitting experience. Further, the configuration of back section 62 with longframe member 21 and the associated linear actuators permits pivoting of back section 62 up to 85 degrees from horizontal, a position typically uncomfortable in a non-rotating bed. But once rotated and feet can be planted on the floor, and 85 degree back surface can be both desirable and greatly assist the bed occupant to stand up from the bed.

Healthcare bed 10 is also provided with an appropriate master control means (not shown) to power the linear actuators, and controls for activating the various linear actuators are located on side rail assemblies 125 and 126, as is known in the art.

Alternative embodiments are contemplated wherein one or both of the lower leg surfaces may be provided with similar or the same rollers as the rollers 98 of back section 62 to facilitate a more desirable longitudinal movement of the mattress panels during articulation.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

I claim:

1. A bed, comprising:

a bed frame, and;

an articulating bed surface including a back section, a seat section and a lower leg section and wherein the seat section is pivotally mounted to the bed frame to rotate about a substantially vertical axis between a home position aligned with said bed frame and an egress position away front the home position, and wherein the back section is pivotally mounted to the seat section about a first horizontal axis to pivot between reclined and inclined positions, and wherein the back section comprises a frame with opposing side bars and opposing crossbars and includes a plurality of rollers rotatably mounted to and between the opposing side bars and between and parallel to the opposing crossbars.

2. The bed of claim 1 wherein the lower leg section has opposing upper and lower crossbars and is pivotally mounted about a third axis at its lower crossbar to said bed frame.

3. The bed of claim 2 wherein said articulating bed surface further includes an upper leg section pivotally mounted to the seat section about a second axis parallel to the first axis and the lower leg section is releasably pivotally connected about a fourth axis at its upper crossbar to the upper leg section.

4. The bed of claim 3 further including a plurality of mattress panels each having an upper surface, said mattress panels including first and second upper panels positioned atop the back, seat and upper leg sections and a lower leg panel positioned atop the lower leg section.

5. The bed of claim 4 wherein the first and second upper panels are hingedly connected to each other at their upper surfaces.

6. The bed of claim 5 wherein the seat and upper leg sections each include mattress support rods extending between their opposing side bars and wherein the first upper panel rests atop the seat and upper leg sections and their mattress support rods and the second upper panel rests atop the back section and its rollers.

7. The bed of claim 1 wherein the plurality of rollers are each mounted for rotation about axes parallel to the first horizontal axis.

8. The bed of claim 7 wherein the plurality of rollers are spaced about 2inches apart from each other.

9. The bed of claim 7 wherein one of the plurality of rollers is spaced about 2inches from one of the opposing crossbars and another of the plurality of rollers is spaced about 2 inches from the other of the opposing crossbars.

10. The bed of claim 1 further including a plurality of mattress panels each having an upper surface, said mattress panels including first and second upper panels positioned atop the back and seat sections and a lower leg panel positioned atop the lower leg section.

11. The bed of claim 10 wherein the first and second upper panels are hingedly connected to each other at their upper surfaces.

12. The bed of claim 11 wherein the seat section includes mattress support rods extending between its opposing side bars and wherein the first upper panel rests atop the seat section and its mattress support rods and the second upper panel rests atop the back section and its rollers.

13. The bed of claim 1 wherein said articulating bed surface further includes an upper leg section pivotally mounted to the seat section about a second axis parallel to the first axis.

14. The bed of claim 13 further including a plurality of mattress panels each having an upper surface, said mattress panels including first and second upper panels positioned atop the back, seat and upper leg sections and a lower leg panel positioned atop the lower leg section.

15. The bed of claim 14 wherein the first and second upper panels are hingedly connected to each other at their upper surfaces.

16. The bed of claim 15 wherein the seat and upper leg sections each include mattress support rods extending between their opposing side bars and wherein the first upper panel rests atop the seat and upper leg sections and their mattress support rods and the second upper panel rests atop the back section and its rollers.

17. The bed of claim 1 wherein in the home position the seat section is aligned with the bed frame and in the egress position the seat section is rotated about 90 degrees from the home position.

* * * * *